US009135880B2

(12) United States Patent
Koyama

(10) Patent No.: US 9,135,880 B2
(45) Date of Patent: Sep. 15, 2015

(54) CONTROL CIRCUIT OF LIQUID CRYSTAL DISPLAY DEVICE, LIQUID CRYSTAL DISPLAY DEVICE, AND ELECTRONIC DEVICE INCLUDING LIQUID CRYSTAL DISPLAY DEVICE

(75) Inventor: Jun Koyama, Sagamihara (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 702 days.

(21) Appl. No.: 13/197,823

(22) Filed: Aug. 4, 2011

(65) Prior Publication Data

US 2012/0038618 A1 Feb. 16, 2012

(30) Foreign Application Priority Data

Aug. 16, 2010 (JP) ..... 2010-181539

(51) Int. Cl.
*G09G 3/36* (2006.01)
*G09G 5/00* (2006.01)

(52) U.S. Cl.
CPC ..... *G09G 3/3688* (2013.01); *G09G 2320/106* (2013.01); *G09G 2330/021* (2013.01)

(58) Field of Classification Search
USPC ..... 345/204, 87, 212, 100
See application file for complete search history.

(56) References Cited

U.S. PATENT DOCUMENTS

| | | | |
|---|---|---|---|
| 5,389,894 | A | 2/1995 | Ryat |
| 5,731,856 | A | 3/1998 | Kim et al. |
| 5,744,864 | A | 4/1998 | Cillessen et al. |
| 5,844,535 | A | 12/1998 | Itoh et al. |

(Continued)

FOREIGN PATENT DOCUMENTS

| | | | |
|---|---|---|---|
| EP | 1737044 | A | 12/2006 |
| EP | 2226847 | A | 9/2010 |

(Continued)

OTHER PUBLICATIONS

Tsuda et al., "Ultra Low Power Consumption Technologies for Mobile TFT-LCDs," IDW '02: Proceedings of the 9th International Display Workshops, Dec. 4, 2002, pp. 295-298.

(Continued)

*Primary Examiner* — Grant Sitta
(74) *Attorney, Agent, or Firm* — Eric J. Robinson; Robinson Intellectual Property Law Office, P.C.

(57) ABSTRACT

A current that flows through a common source amplifier circuit provided in a current amplifier circuit of an operational amplifier in displaying a moving image is made to be different from that in displaying a still image. Specifically, in one embodiment of the present invention, current source circuits which are provided in the current amplifier circuit in the operational amplifier operate by switching the current source circuit used for displaying a moving image and the current source circuit used for displaying a still image. The current amplitude in the common source amplifier circuit is controlled by switching the current source circuits, whereby low power consumption in the power supply circuit is achieved. The switching of the current source circuit in the operational amplifier is performed by a display control circuit for controlling a liquid crystal display panel in order to switch moving image display and still image display.

30 Claims, 15 Drawing Sheets

(56) References Cited

U.S. PATENT DOCUMENTS

| | | | | |
|---|---|---|---|---|
| 5,977,940 | A | 11/1999 | Akiyama et al. | |
| 6,137,356 | A | 10/2000 | Sakuragi | |
| 6,294,274 | B1 | 9/2001 | Kawazoe et al. | |
| 6,317,109 | B1 * | 11/2001 | Lee | 345/87 |
| 6,329,973 | B1 | 12/2001 | Akimoto et al. | |
| 6,452,579 | B1 | 9/2002 | Itoh et al. | |
| 6,480,178 | B1 | 11/2002 | Itakura et al. | |
| 6,563,174 | B2 | 5/2003 | Kawasaki et al. | |
| 6,727,522 | B1 | 4/2004 | Kawasaki et al. | |
| 7,006,114 | B2 | 2/2006 | Sakaguchi | |
| 7,049,190 | B2 | 5/2006 | Takeda et al. | |
| 7,061,014 | B2 | 6/2006 | Hosono et al. | |
| 7,064,346 | B2 | 6/2006 | Kawasaki et al. | |
| 7,105,868 | B2 | 9/2006 | Nause et al. | |
| 7,211,825 | B2 | 5/2007 | Shih et al | |
| 7,253,391 | B2 | 8/2007 | Koyama et al. | |
| 7,282,782 | B2 | 10/2007 | Hoffman et al. | |
| 7,286,108 | B2 | 10/2007 | Tsuda et al. | |
| 7,297,977 | B2 | 11/2007 | Hoffman et al. | |
| 7,321,353 | B2 | 1/2008 | Tsuda et al. | |
| 7,323,356 | B2 | 1/2008 | Hosono et al. | |
| 7,358,952 | B2 | 4/2008 | Mamba et al. | |
| 7,369,143 | B2 | 5/2008 | Koyama | |
| 7,385,224 | B2 | 6/2008 | Ishii et al. | |
| 7,402,506 | B2 | 7/2008 | Levy et al. | |
| 7,411,209 | B2 | 8/2008 | Endo et al. | |
| 7,453,065 | B2 | 11/2008 | Saito et al. | |
| 7,453,087 | B2 | 11/2008 | Iwasaki | |
| 7,462,862 | B2 | 12/2008 | Hoffman et al. | |
| 7,468,304 | B2 | 12/2008 | Kaji et al. | |
| 7,501,293 | B2 | 3/2009 | Ito et al. | |
| 7,573,333 | B2 | 8/2009 | Yokota | |
| 7,674,650 | B2 | 3/2010 | Akimoto et al. | |
| 7,732,819 | B2 | 6/2010 | Akimoto et al. | |
| 7,791,072 | B2 | 9/2010 | Kumomi et al. | |
| 7,791,074 | B2 | 9/2010 | Iwasaki | |
| 8,144,144 | B2 | 3/2012 | Koyama | |
| 2001/0046027 | A1 | 11/2001 | Tai et al. | |
| 2002/0056838 | A1 | 5/2002 | Ogawa | |
| 2002/0132454 | A1 | 9/2002 | Ohtsu et al. | |
| 2002/0140685 | A1 | 10/2002 | Yamamoto et al. | |
| 2003/0189401 | A1 | 10/2003 | Kido et al. | |
| 2003/0218222 | A1 | 11/2003 | Wager et al. | |
| 2004/0038446 | A1 | 2/2004 | Takeda et al. | |
| 2004/0127038 | A1 | 7/2004 | Carcia et al. | |
| 2005/0017302 | A1 | 1/2005 | Hoffman | |
| 2005/0199959 | A1 | 9/2005 | Chiang et al. | |
| 2006/0035452 | A1 | 2/2006 | Carcia et al. | |
| 2006/0043377 | A1 | 3/2006 | Hoffman et al. | |
| 2006/0091793 | A1 | 5/2006 | Baude et al. | |
| 2006/0108529 | A1 | 5/2006 | Saito et al. | |
| 2006/0108636 | A1 | 5/2006 | Sano et al. | |
| 2006/0110867 | A1 | 5/2006 | Yabuta et al. | |
| 2006/0113536 | A1 | 6/2006 | Kumomi et al. | |
| 2006/0113539 | A1 | 6/2006 | Sano et al. | |
| 2006/0113549 | A1 | 6/2006 | Den et al. | |
| 2006/0113565 | A1 | 6/2006 | Abe et al. | |
| 2006/0169973 | A1 | 8/2006 | Isa et al. | |
| 2006/0170111 | A1 | 8/2006 | Isa et al. | |
| 2006/0197092 | A1 | 9/2006 | Hoffman et al. | |
| 2006/0208977 | A1 | 9/2006 | Kimura | |
| 2006/0228974 | A1 | 10/2006 | Thelss et al. | |
| 2006/0231882 | A1 | 10/2006 | Kim et al. | |
| 2006/0238135 | A1 | 10/2006 | Kimura | |
| 2006/0244107 | A1 | 11/2006 | Sugihara et al. | |
| 2006/0284171 | A1 | 12/2006 | Levy et al. | |
| 2006/0284172 | A1 | 12/2006 | Ishii | |
| 2006/0292777 | A1 | 12/2006 | Dunbar | |
| 2007/0024187 | A1 | 2/2007 | Shin et al. | |
| 2007/0046191 | A1 | 3/2007 | Saito | |
| 2007/0052025 | A1 | 3/2007 | Yabuta | |
| 2007/0054507 | A1 | 3/2007 | Kaji et al. | |
| 2007/0072439 | A1 | 3/2007 | Akimoto et al. | |
| 2007/0090365 | A1 | 4/2007 | Hayashi et al. | |
| 2007/0108446 | A1 | 5/2007 | Akimoto et al. | |
| 2007/0152217 | A1 | 7/2007 | Lai et al. | |
| 2007/0172591 | A1 | 7/2007 | Seo et al. | |
| 2007/0187678 | A1 | 8/2007 | Hirao et al. | |
| 2007/0187760 | A1 | 8/2007 | Furuta et al. | |
| 2007/0194379 | A1 | 8/2007 | Hosono et al. | |
| 2007/0252928 | A1 | 11/2007 | Ito et al. | |
| 2007/0272922 | A1 | 11/2007 | Kim et al. | |
| 2007/0287296 | A1 | 12/2007 | Chang | |
| 2008/0006877 | A1 | 1/2008 | Mardilovich et al. | |
| 2008/0038882 | A1 | 2/2008 | Takechi et al. | |
| 2008/0038929 | A1 | 2/2008 | Chang | |
| 2008/0050595 | A1 | 2/2008 | Nakagawara et al. | |
| 2008/0055218 | A1 | 3/2008 | Tsuda et al. | |
| 2008/0073653 | A1 | 3/2008 | Iwasaki | |
| 2008/0083950 | A1 | 4/2008 | Pan et al. | |
| 2008/0106191 | A1 | 5/2008 | Kawase | |
| 2008/0128689 | A1 | 6/2008 | Lee et al. | |
| 2008/0129195 | A1 | 6/2008 | Ishizaki et al. | |
| 2008/0166834 | A1 | 7/2008 | Kim et al. | |
| 2008/0182358 | A1 | 7/2008 | Cowdery-Corvan et al. | |
| 2008/0224133 | A1 | 9/2008 | Park et al. | |
| 2008/0254569 | A1 | 10/2008 | Hoffman et al. | |
| 2008/0258139 | A1 | 10/2008 | Ito et al. | |
| 2008/0258140 | A1 | 10/2008 | Lee et al. | |
| 2008/0258141 | A1 | 10/2008 | Park et al. | |
| 2008/0258143 | A1 | 10/2008 | Kim et al. | |
| 2008/0296568 | A1 | 12/2008 | Ryu et al. | |
| 2009/0009505 | A1 * | 1/2009 | Koyama | 345/212 |
| 2009/0068773 | A1 | 3/2009 | Lai et al. | |
| 2009/0073325 | A1 | 3/2009 | Kuwabara et al. | |
| 2009/0114910 | A1 | 5/2009 | Chang | |
| 2009/0134399 | A1 | 5/2009 | Sakakura et al. | |
| 2009/0152506 | A1 | 6/2009 | Umeda et al. | |
| 2009/0152541 | A1 | 6/2009 | Maekawa et al. | |
| 2009/0261325 | A1 | 10/2009 | Kawamura et al. | |
| 2009/0267064 | A1 | 10/2009 | Yano et al. | |
| 2009/0278122 | A1 | 11/2009 | Hosono et al. | |
| 2009/0280600 | A1 | 11/2009 | Hosono et al. | |
| 2010/0065844 | A1 | 3/2010 | Tokunaga | |
| 2010/0092800 | A1 | 4/2010 | Itagaki et al. | |
| 2010/0109002 | A1 | 5/2010 | Itagaki et al. | |

FOREIGN PATENT DOCUMENTS

| | | | |
|---|---|---|---|
| JP | 60-198861 | A | 10/1985 |
| JP | 63-210022 | A | 8/1988 |
| JP | 63-210023 | A | 8/1988 |
| JP | 63-210024 | A | 8/1988 |
| JP | 63-215519 | A | 9/1988 |
| JP | 63-239117 | A | 10/1988 |
| JP | 63-265818 | A | 11/1988 |
| JP | 05-251705 | A | 9/1993 |
| JP | 08-264794 | A | 10/1996 |
| JP | 11-505377 | | 5/1999 |
| JP | 11-160673 | | 6/1999 |
| JP | 2000-044236 | A | 2/2000 |
| JP | 2000-150900 | A | 5/2000 |
| JP | 2002-076356 | A | 3/2002 |
| JP | 2002-099262 | A | 4/2002 |
| JP | 2002-169499 | A | 6/2002 |
| JP | 2002-289859 | A | 10/2002 |
| JP | 2003-086000 | A | 3/2003 |
| JP | 2003-086808 | A | 3/2003 |
| JP | 2004-103957 | A | 4/2004 |
| JP | 2004-138958 | A | 5/2004 |
| JP | 2004-273614 | A | 9/2004 |
| JP | 2004-273732 | A | 9/2004 |
| WO | WO-2004/114391 | | 12/2004 |

OTHER PUBLICATIONS

Fortunato.E et al., "Wide-Bandgap High-Mobility ZNO Thin-Film Transistors Produced at Room Temperature,", Appl. Phys. Lett. (Applied Physics Letters) , Sep. 27, 2004, vol. 85, No. 13, pp. 2541-2543.

Dembo.H et al., "RFCPUS on Glass and Plastic Substrates Fabricated by TFT Transfer Technology,", IEDM 05: Technical Digest of International Electron Devices Meeting, Dec. 5, 2005, pp. 1067-1069.

(56) References Cited

OTHER PUBLICATIONS

Ikeda.T et al., "Full-Functional System Liquid Crystal Display Using CG-Silicon Technology,", SID Digest '04 : SID International Symposium Digest of Technical Papers, 2004, vol. 35, pp. 860-863.
Nomura.K et al., "Room-Temperature Fabrication of Transparent Flexible Thin-Film Transistors Using Amorphous Oxide Semiconductors,", Nature, Nov. 25, 2004, vol. 432, pp. 488-492.
Park.J et al., "Improvements in the Device Characteristics of Amorphous Indium Gallium Zinc Oxide Thin-Film Transistors by Ar Plasma treatment,", Appl. Phys. Lett. (Applied Physics Letters) , Jun. 26, 2007, vol. 90, No. 26, pp. 262106-1-262106-3.
Takahashi.M et al., "Theoretical Analysis of Igzo Transparent Amorphous Oxide Semiconductor,", IDW '08 : Proceedings of the 15th International Display Workshops, Dec. 3, 2008, pp. 1637-1640.
Hayashi.R et al., "42.1: Invited Paper: Improved Amorphous In—Ga—Zn—O TFTS,", SID Digest '08 : SID International Symposium Digest of Technical Papers, May 20, 2008, vol. 39, pp. 621-624.
Prins.M et al., "A Ferroelectric Transparent Thin-Film Transistor,", Appl. Phys. Lett. (Applied Physics Letters) , Jun. 17, 1996, vol. 68, No. 25, pp. 3650-3652.
Nakamura.M et al., "The phase relations in the In2O3—Ga2ZnO4—ZnO system at 1350° C,", Journal of Solid State Chemistry, Aug. 1, 1991, vol. 93, No. 2, pp. 298-315.
Kimizuka.N et al., "Syntheses and Single-Crystal Data of Homologous Compounds, In2O3(ZnO)m (m = 3, 4; and 5), InGaO3(ZnO)3, and Ga2O3(ZnO)m (m = 7, 8, 9, and 16) in the In2O3—ZnGa2O4—ZnO System,", Journal of Solid State Chemistry, Apr. 1, 1995, vol. 116, No. 1, pp. 170-178.
Nomura.K et al., "Thin-Film Transistor Fabricated in Single-Crystalline Transparent Oxide Semiconductor,", Science, May 23, 2003, vol. 300, No. 5623, pp. 1269-1272.
Masuda.S et al., "Transparent thin film transistors using ZnO as an active channel layer and their electrical properties,", J. Appl. Phys. (Journal of Applied Physics) , Feb. 1, 2003, vol. 93, No. 3, pp. 1624-1630.
Asakuma.N et al., "Crystallization and Reduction of SOL-GEL-Derived Zinc Oxide Films by Irradiation with Ultraviolet Lamp,", Journal of SOL-GEL Science and Technology, 2003, vol. 26, pp. 181-184.
Osada.T et al., "15.2: Development of Driver-Integrated Panel using Amorphous In—Ga—Zn-Oxide TFT,", SID Digest '09 : SID International Symposium Digest of Technical Papers, May 31, 2009, pp. 184-187.
Nomura.K et al., "Carrier transport in transparent oxide semiconductor with intrinsic structural randomness probed using single-crystalline InGaO3(ZnO)5 films,", Appl. Phys. Lett. (Applied Physics Letters) , Sep. 13, 2004, vol. 85, No. 11, pp. 1993-1995.
Li.C et al., "Modulated Structures of Homologous Compounds InMO3(ZnO)m (M=In,Ga; m=Integer) Described by Four-Dimensional Superspace Group,", Journal of Solid State Chemistry, 1998, vol. 139, pp. 347-355.
Son.K et al., "42.4L: Late-News Paper: 4 Inch QVGA AMOLED Driven by the Threshold Voltage Contolled Amorphous GIZO (Ga2O3—In2O3—ZnO) TFT,", SID Digest '08 : SID International Symposium Digest of Technical Papers, May 20, 2008, vol. 39, pp. 633-636.
Lee.J et al., "World's Largest (15-Inch) XGA AMLCD Panel Using IGZO Oxide TFT,", SID Digest '08 : SID Intenational Symposium Digest of Technical Papers, May 20, 2008, vol. 39, pp. 625-628.
Nowatari.H et al., "60.2: Intermediate Connector With Suppressed Voltage Loss for White Tandem OLEDS,", SID Digest '09 : SID International Symposium Digest of Technical Papers, May 31, 2009, vol. 40, pp. 899-902.
Kanno.H et al., "White Stacked Electrophosphorecent Organic Light-Emitting Devices Employing MOO3 as a Charge-Generation Layer,", Adv. Mater. (Advanced Materials), 2006, vol. 18, No. 3, pp. 339-342.
Van de Walle.C, "Hydrogen as a Cause of Doping in Zinc Oxide,", Phys. Rev. Lett. (Physical Review Letters), Jul. 31, 2000, vol. 85, No. 5, pp. 1012-1015.
Fung.T et al., "2-D Numerical Simulation of High Performance Amorphous In—Ga—Zn—O TFTs for Flat Panel Displays,", AM-FPD '08 Digest of Technical Papers, Jul. 2, 2008, pp. 251-252, The Japan Society of Applied Physics.
Jeong.J et al., "3.1: Distinguished Paper: 12.1-Inch WXGA AMOLED Display Driven by Indium—Gallium—Zinc Oxide TFTs Array,", SID Digest '08 : SID International Symposium of Technical Papers, May 20, 2008, vol. 39, No. 1, pp. 1-4.
Park.J et al., "High performance amorphous oxide thin film transistors with self-aligned top-gate structure,", IEDM 09: Technical Digest of International Electron Devices Meeting, Dec. 7, 2009, pp. 191-194.
Kurokawa.Y et al., "UHF RFCPUS on Flexible and Glass Substrates for Secure RFID Systems,", Journal of Solid-State Circuits, 2008, vol. 43, No. 1, pp. 292-299.
Ohara.H et al., "Amorphous In—Ga—Zn—Oxide TFTs with Suppressed Variation for 4.0 inch QVGA AMOLED Display,", AM-FPD '09 Digest of Technical Papers, Jul. 1, 2009, pp. 227-230, The Japan Society of Applied Physics.
Coates.D et al., "Optical Studies of the Amorphous Liquid-Cholesteric Liquid Crystal Transition:The "Blue Phase",", Physics Letters, Sep. 10, 1973, vol. 45A, No. 2, pp. 115-116.
Cho.D et al., "21.2:AL and SN-Doped Zinc Indium Oxide Thin Film Transistors for AMOLED Back-Plane,", SID Digest '09 : SID International Symposium Digest of Technical Papers, May 31, 2009, pp. 280-283.
Lee.M et al., "15.4:Excellent Performance of Indium-Oxide-Based Thin-Film Transistors by DC Sputtering,", SID Digest '09 : SID International Symposium Digest of Technical Papers, May 31, 2009, pp. 191-193.
Jin.D et al., "65.2:Distinguished Paper:World-Largest (6.5") Flexible Full Color Top Emission AMOLED Display on Plastic Film and its Bending Properties,", SID Digest '09 : SID International Symposium Digest of Technical Papers, May 31, 2009, pp. 983-985.
Sakata.J et al., "Development of 4.0-IN. AMOLED Display With Driver Circuit Using Amorphous In—Ga—Zn—Oxide TFTS,", IDW '09 : Proceedings of the 16th International Display Workshops, 2009, pp. 689-692.
Park.J et al., "Amorphous Indium—Gallium—Zinc Oxide TFTs and Their Application for Large Size AMOLED,", AM-FPD '08 Digest of Technical Papers, Jul. 2, 2008, pp. 275-278.
Park.S et al., "Challenge to Future Displays: Transparent AM-OLED Driven by Peald Grown ZNO TFT,", IMID '07 Digest, 2007, pp. 1249-1252.
Godo.H et al., "Temperature Dependence of Characteristics and Electronic Structure for Amorphous In—Ga—Zn—Oxide TFT,", AM-FPD '09 Digest of Technical Papers, Jul. 1, 2009, pp. 41-44.
Osada.T et al., "Development of Driver-Integrated Panel Using Amorphous In—Ga—Zn—Oxide TFT,", AM-FPD '09 Digest of Technical Papers, Jul. 1, 2009, pp. 33-36.
Hirao.T et al., "Novel Top-Gate Zinc Oxide Thin-Film Transistors (ZNO TFTs) for AMLCDS,", Journal of the SID, 2007, vol. 15, No. 1, pp. 17-22.
Hosono.H, "68.3:Invited Paper:Transparent Amorphous Oxide Semiconductors for High Performance TFT,", SID Digest '07 : SID International Symposium Digest of Technical Papers, 2007, vol. 38, pp. 1830-1833.
Godo.H et al., "P-9:Numerical Analysis on Temperature Dependence of Characteristics of Amorphous In—Ga—Zn—Oxide TFT,", SID Digest '09 : SID International Symposium Digest of Technical Papers, May 31, 2009, pp. 1110-1112.
Ohara.H et al., "21.3:4.0 IN. QVGA AMOLED Display Using In—Ga—Zn—Oxide TFTs With a Novel Passivation Layer,", SID Digest '09 : SID International Symposium Digest of Technical Papers, May 31, 2009, pp. 284-287.
Miyasaka.M, "Suftla Flexible Microelectronics on Their Way to Business,", SID Digest '07 : SID International Symposium Digest of Technical Papers, 2007, vol. 38, pp. 1673-1676.

(56) References Cited

OTHER PUBLICATIONS

Chern.H at al., "An Analytical Model for the Above-Threshold Characteristics of Polysilicon Thin-Film Transistors,", IEEE Transactions on Electron Devices, Jul. 1, 1995, vol. 42, No. 7, pp. 1240-1246.
Kikuchi.H at al., "39.1:Invited Paper:Optically Isotropic Nano-Structured Liquid Crystal Composites for Display Applications,", SID Digest '09 : SID International Symposium Digest of Technical Papers, May 31, 2009, pp. 578-581.
Asaoka.Y et al., "29.1:Polarizer-Free Reflective LCD Combined With Ultra Low-Power Driving Technology,", SID Digest '09 : SID International Symposium Digest of Technical Papers, May 31, 2009, pp. 395-398.
Lee.H at al., "Current Status of, Challenges to, and Perspective View of AM-OLED ,", IDW '06 : Proceedings of the 13th International Display Workshops, Dec. 7, 2006, pp. 663-666.
Kikuchi.H et al., "62.2:Invited Paper:Fast Electro-Optical Switching in Polymer-Stabilized Liquid Crystalline blue Phases for Display Application,", SID Digest '07 : SID International Symposium Digest of Technical Papers, 2007, vol. 38, pp. 1737-1740.
Nakamura.M, "Synthesis of Homologous Compound with New Long-Period Structure,", NIRIM Newsletter, Mar. 1, 1995, vol. 150, pp. 1-4.
Kikuchi.H et al., "Polymer-Stabilized Liquid Crystal Blue Phases,", Nature Materials, Sep. 2, 2002, vol. 1, pp. 64-68.
Kimizuka.N et al., "Spinel,YBFE2O4, and YB2FE3O7 Types of Structures for Compounds in the IN2O3—A2O3—BO systems [A; Fe, Ga, or Al; B: Mg, Mn, Fe, Ni, Cu,or Zn] at temperatures Over 1000° C.,", Journal of Solid State Chemistry, 1985, vol. 60, pp. 382-384.
Kitzerow.H et al., "Observation of Blue Phases in Chiral Networks,", Liquid Crystals, 1993, vol. 14, No. 3, pp. 911-916.
Costello.M et al., "Electron Microscopy of a Cholesteric Liquid Crystal and Its Blue Phase,", Phys. Rev. A (Physical Review.A), May 1, 1984, vol. 29, No. 5, pp. 2957-2959.
Meiboom.S et al., "Theory of the Blue Phase of Cholesteric Liquid Crystals,", Phys. Rev. Lett. (Physical Review Letters), May 4, 1981, vol. 46, No. 18, pp. 1216-1219.
Park.Sang-Hee et al., "42.3: Transparent ZnO Thin Film Transistor for the Application of High Aperture Ratio Bottom Emission AM-OLED Display,", SID Digest '08 : SID International Symposium Digest of Technical Papers, May 20, 2008, vol. 39, pp. 629-632.
Orita.M et al., "Mechanism of Electrical Conductivity of Transparent InGaZnO4,", Phys. Rev. B (Physical Review.B), Jan. 15, 2000, vol. 61, No. 3, pp. 1811-1816.
Nomura.K et al., "Amorphous Oxide Semiconductors for High-Performance Flexible Thin-Film Transistors,", Jpn. J. Appl. Phys. (Japanese Journal of Applied Physics) , 2006, vol. 45, No. 5B, pp. 4303-4308.
Janotti.A et al., "Native Point Defects in ZnO,", Phys. Rev. B (Physical Review. B), Oct. 4, 2007, vol. 76, No. 16, pp. 165202-1-165202-22.
Park.J et al., "Electronic Transport Properties of Amorphous Indium—Gallium—Zinc Oxide Semiconductor Upon Exposure to Water,", Appl. Phys. Lett. (Applied Physics Letters) , 2008, vol. 92, pp. 072104-1-072104-3.
Hsieh.H et al., "P-29:Modeling of Amorphous Oxide Semiconductor Thin Film Transistors and Subgap Density of States,", SID digest '08 : SID International Symposium Digest of Technical papers, vol. 39, pp. 1277-1280.
Janotti.A et al., "Oxygen Vacancies In ZnO,", Appl. Phys. Lett. (Applied Physics Letters) , 2005, vol. 87, pp. 122102-1-122102-3.
Oba.F et al., "Defect energetics in ZnO: A hybrid Hartree-Fock density functional study,", Phys. Rev. B (Physical Review. B), vol. 77, pp. 245202-1-245202-6.
Orita.M et al., "Amorphous transparent conductive oxide InGaO3(ZnO)m (m<4):a Zn4s conductor,", Philosophical Magazine, 2001, vol. 81, No. 5, pp. 501-515.
Hosono.H et al., "Working hypothesis to explore novel wide band gap electrically conducting amorphous oxides and examples,", J. Non-Cryst. Solids (Journal of Non-Crystalline Solids), 1996, vol. 198-200, pp. 165-169.
Mo.Y et al., "Amorphous Oxide TFT Backplanes for Large Size AMOLED Displays,", IDW '08 : Proceedings of the 6th International Display Workshops, Dec. 3, 2008, pp. 581-584.
Kim.S et al., "High-Performance oxide thin film transistors passivated by various gas plasmas,", 214th ECS Meeting, 2008, No. 2317, ECS.
Clark.S et al., "First Principles Methods Using CASTEP,", Zeitschrift fur Kristallographie, 2005, vol. 220, pp. 567-570.
Lany.S et al., "Dopability, Intrinsic Conductivity, and Nonstoichiometry of Transparent Conducting Oxides,", Phys. Rev. Lett. (Physical Review Letters), Jan. 26, 2007, vol. 98, pp. 045501-1-045501-4.
Park.J et al., "Dry etching of ZnO films and plasma-induced damage to optical properties,", J. Vac. Sci. Technol. B. (Journal of Vacuum Science & Technology B), Mar. 1, 2003, vol. 21, No. 2, pp. 800-803.
Oh.M et al., "Improving the Gate Stability of ZNO Thin-Film Transistors With Aluminum Oxide Dielectric Layers,", J. Electrochem. Soc. (Journal of the Electrochemical Society), 2008, vol. 155, No. 12, pp. H1009-H1014.
Ueno.K et al., "Field-Effect Transistor on SrTiO3 With Sputtered AI203 Gate Insulator,", Appl. Phys. Lett. (Applied Physics Letters) , Sep. 1, 2003, vol. 83, No. 9, pp. 1755-1757.

* cited by examiner

CONTROL CIRCUIT OF LIQUID CRYSTAL DISPLAY DEVICE, LIQUID CRYSTAL DISPLAY DEVICE, AND ELECTRONIC DEVICE INCLUDING LIQUID CRYSTAL DISPLAY DEVICE

BACKGROUND OF THE INVENTION

1. Field of the Invention

The present invention relates to control circuits of liquid crystal display devices, liquid crystal display devices, and electronic devices provided with liquid crystal display devices.

2. Description of the Related Art

Liquid crystal display devices ranging from a large display device such as a television receiver to a small display device such as a mobile phone have been spreading. From now on, products with higher added values will be needed and are being developed. In addition, there has been a growing interest in global environment, and the development of liquid crystal display devices consuming less power has thus attracted attention.

Non-Patent Document 1 discloses a structure of a liquid crystal display device where refresh rates differ between the case of moving image display and the case of still image display in order to achieve low power consumption of the liquid crystal display device.

In addition, in the liquid crystal display device, liquid crystal molecules are sandwiched between a pixel electrode and a counter electrode, and the alignment of the liquid crystal molecules is controlled by a voltage which is applied between the pixel electrode and the counter electrode. The voltage of the pixel electrode is set to a desired level by controlling switching of a thin film transistor provided in each pixel. The counter electrode is provided on a counter substrate provided with liquid crystal molecules which are sandwiched between the counter substrate and a substrate provided with the pixel electrode. The counter electrode is not provided for each pixel but provided over the entire surface; therefore, the voltage of the counter electrode is controlled to have a predetermined level by an operational amplifier in a power supply circuit.

A circuit configuration of the operational amplifier used in the liquid crystal display device is disclosed in Patent Document 1 (e.g., see FIG. 6).

REFERENCE

[Patent Document 1] Japanese Published Patent Application No. 11-160673

Non-Patent Document

[Non-Patent Document 1] Kazuhiko Tsuda et al., IDW'02, pp295-298

SUMMARY OF THE INVENTION

The structure of a liquid crystal display device where refresh rates differ between the case of moving image display and the case of still image display in order to achieve low power consumption of the liquid crystal display device will be described.

In the case where a moving image is displayed in a liquid crystal display device, the voltage of a pixel electrode is updated as needed. Therefore, it is necessary to keep the voltage of a counter electrode constant so that the voltage of the counter electrode does not change due to a leakage current from the pixel electrode through liquid crystal molecules. The current supply capability of an operational amplifier in a power supply circuit needs to be set high so that the voltage of the counter electrode is kept constant.

On the other hand, in the case where a still image is displayed in the liquid crystal display device by reducing a refresh rate, the voltage of the pixel electrode is kept constant. Therefore, in a manner similar to that of displaying a moving image, the voltage of the counter electrode changes due to a leakage current from the pixel electrode through liquid crystal molecules. However, since the voltage of the pixel electrode is held, the current supply capability of the operational amplifier for holding the voltage of the counter electrode constant, which is provided in the power supply circuit, does not need to be set as high as the case where a moving image is displayed.

Here, the circuit configuration of the operational amplifier will be described with reference to FIGS. 15A and 15B. FIG. 15A illustrates a circuit symbol of an operational amplifier, and each terminal is denoted by a reference numeral. In FIG. 15A, the operational amplifier includes a non-inverting input terminal 991, an inverting input terminal 992, an output terminal 993, and a bias voltage input terminal 994.

FIG. 15B is an equivalent circuit diagram of the operational amplifier. The operational amplifier includes a differential circuit including a transistor 901 and a transistor 902; a current mirror circuit including a transistor 903 and a transistor 904; a current source circuit including a transistor 905; a current source circuit including a transistor 909; a common source amplifier circuit including a transistor 906; an idling circuit including a transistor 907 and a transistor 908; a source follower circuit including a transistor 910 and a transistor 911; and a phase compensation capacitor 912. The transistors 903, 904, 906, and 910 are connected to a high power supply voltage side terminal 995; and the transistors 905, 909, and 911 are connected to a low power supply voltage side terminal 996. Note that each terminal of the non-inverting input terminal 991, the inverting input terminal 992, the output terminal 993, and the bias voltage input terminal 994 which are illustrated in FIG. 15A are also illustrated in FIG. 15B.

Note that in FIG. 15B, the differential circuit, the current mirror circuit, and the current source circuit including the transistor 905 are collectively referred to as a differential amplifier circuit 921. In addition, the common source amplifier circuit, the idling circuit, and the current source circuit including the transistor 909 are collectively referred to as a current amplifier circuit 922. Further, the transistors 910 and 911 are collectively referred to as a source follower circuit 923.

An operation of the circuit in FIG. 15B will be briefly described. When an H-level signal is input into the non-inverting input terminal 991, the drain current of the transistor 901 becomes larger than the drain current of the transistor 902. This is because the current source circuit including the transistor 905 is connected to sources of the transistors included in the differential circuit. Since the transistor 904 and the transistor 903 are included in the current mirror circuit, the drain current of the transistor 903 comes to be equal to the drain current of the transistor 902. Thus, a difference (different current) between the drain current of the transistor 903 and the drain current of the transistor 901 is generated. The gate potential of the transistor 906 is lowered by a different current between the drain current of the transistor 903 and the drain current of the transistor 901. The transistor 906 is a p-type transistor; therefore, the drain current is raised when the gate potential of the transistor 906 is lowered. Thus, the gate potential of the transistor 910 is raised and therefore the source potential of the transistor 910, that is, the output voltage of the output terminal 993 is also raised. Note that the same operation is performed even when an L-level signal is input into the inverting input terminal 992.

When an L-level signal is input into the non-inverting input terminal 991, the drain current of the transistor 901 becomes smaller than the drain current of the transistor 902. The drain current of the transistor 903 is the same as the drain current of the transistor 902. The gate potential of the transistor 906 is raised by a different current between the drain current of the transistor 903 and the drain current of the transistor 901. The transistor 906 is a p-type transistor; therefore, the drain current is lowered when the gate potential of the transistor 906 is raised. Thus, the gate potential of the transistor 910 is lowered and therefore the source potential of the transistor 910, that is, the output voltage of the output terminal 993 is also lowered. A signal whose phase is the same as that of the signal of the non-inverting input terminal 991 is output from the output terminal 993. Note that the same operation is performed even when an H-level signal is input into the inverting input terminal 992.

In the circuit configuration illustrated in FIG. 15B, an n-type transistor is included in the differential circuit and a p-type transistor is included in the current mirror circuit. This is also the same in the structure where a polarity of each transistor and a polarity of a signal input into each terminal are reversed.

In the circuit configuration of the operational amplifier described in FIGS. 15A and 15B, in the case where a moving image is displayed in a liquid crystal display panel, the current supply capability of the operational amplifier in the power supply circuit needs to be set high so that the voltage of the counter electrode is kept constant. In other words, in the case of FIG. 15B, a current that flows through the current source circuit including the transistor 909, which is included in the current amplifier circuit 922, needs to be set large.

However, in the circuit configuration of the operational amplifier described in FIGS. 15A and 15B, the current supply capability of the operational amplifier in the power supply circuit remain high even in the case where a still image is displayed by reducing the refresh rate in the liquid crystal display panel. This is because, in the case where a still image is displayed, the current supply capability of the operational amplifier does not need to be so high because fluctuation of the voltage of the counter electrode in the liquid crystal display panel is smaller than that of the case where a moving image is displayed. As a result, when the voltage of the counter electrode in the liquid crystal display panel is kept constant, there is a surplus in the current supply capability of the operational amplifier in the power supply circuit; thus, the power consumption of the current amplifier circuit including the transistor 909 is increased.

In a control circuit of the liquid crystal display device, where a moving image and a still image are displayed by switching a refresh rate, low power consumption is achieved by reducing the frequency of rewriting in a driver circuit such as a gate driver and a source driver in a display control circuit. On the other hand, in the power supply circuit of the liquid crystal display device, where a moving image and a still image are displayed by switching a refresh rate, a problem arises in that low power consumption in the operational amplifier is not sufficient.

In view of the above problems, an object of one embodiment of the present invention is to achieve low power consumption in a power supply circuit of a liquid crystal display device when a moving image and a still image are displayed by switching a refresh rate in a control circuit of the liquid crystal display device.

In order to solve the above problems, in one embodiment of the present invention, a current that flows through a common source amplifier circuit provided in a current amplifier circuit of an operational amplifier in displaying a moving image is made to be different from that in displaying a still image. Specifically, in one embodiment of the present invention, current source circuits which are provided in the current amplifier circuit in the operational amplifier operate by switching the current source circuit used for displaying a moving image and the current source circuit used for displaying a still image. The current amplitude in the common source amplifier circuit is controlled by switching the current source circuits, whereby low power consumption in the power supply circuit is achieved. The switching of the current source circuits in the operational amplifier is performed by a display control circuit for controlling a liquid crystal display panel in order to switch moving image display and still image display.

One embodiment of the present invention is a control circuit of a liquid crystal display device including a display control circuit for controlling a liquid crystal display panel in which a moving image is displayed in an image control signal output period or a still image is displayed in an image control signal stop period; and a power supply circuit including a differential amplifier circuit, a source follower circuit, and a current amplifier circuit having a common source amplifier circuit. In the control circuit, the common source amplifier circuit is a circuit for amplifying a current depending on the amount of current flowing in the image control signal output period and the amount of current flowing in the image control signal stop period.

Another embodiment of the present invention is a control circuit of a liquid crystal display device including a display control circuit for controlling a liquid crystal display panel in which a moving image is displayed in an image control signal output period or a still image is displayed in an image control signal stop period; and a power supply circuit including a differential amplifier circuit, a source follower circuit, and a current amplifier circuit having a common source amplifier circuit, a first current source circuit, and a second current source circuit. In the control circuit, the common source amplifier circuit is a circuit for amplifying a current depending on the amount of current flowing through the first current source circuit in the image control signal output period, and amplifying a current depending on the amount of current flowing through the second current source circuit in the image control signal stop period.

Another embodiment of the present invention is a liquid crystal display device including a liquid crystal display panel for controlling alignment of liquid crystal by a pixel electrode and a counter electrode; a display control circuit for controlling the liquid crystal display panel in which a moving image is displayed in an image control signal output period or a still image is displayed in an image control signal stop period; and a power supply circuit including a differential amplifier circuit, a source follower circuit, and a current amplifier circuit having a common source amplifier circuit. In the liquid crystal display device, the power supply circuit is a circuit for controlling a potential of the counter electrode, and the common source amplifier circuit is a circuit for amplifying a current depending on the amount of current flowing in the image control signal output period and the amount of current flowing in the image control signal stop period.

In the control circuit of the liquid crystal display device according to the embodiment, the first current source circuit and the second current source circuit are connected to a control circuit for a current source circuit for making the amount of current flowing through the first current source circuit different from the amount of current flowing through the second current source circuit and operating the first current source circuit or the second current source circuit.

Another embodiment of the present invention is a liquid crystal display device including a liquid crystal display panel for controlling alignment of liquid crystal by a pixel electrode and a counter electrode; a display control circuit for controlling the liquid crystal display panel in which a moving image is displayed in an image control signal output period or a still image is displayed in an image control signal stop period; and a power supply circuit including a differential amplifier circuit, a source follower circuit, and a current amplifier circuit including a common source amplifier circuit, a first current source circuit, and a second current source circuit. In the liquid crystal display device, the power supply circuit is a circuit for controlling a potential of the counter electrode, and the common source amplifier circuit is a circuit for amplifying a current depending on the amount of current flowing through the first current source circuit in the image control signal output period, and amplifying a current depending on the amount of current flowing through the second current source circuit in the image control signal stop period.

Another embodiment of the present invention is a liquid crystal display device including a liquid crystal display panel for controlling alignment of liquid crystal by a pixel electrode and a counter electrode; a gate driver and a source driver for controlling a potential of the pixel electrode; a display control circuit for controlling the liquid crystal display panel in which a moving image is displayed in an image control signal output period or a still image is displayed in an image control signal stop period by outputting a control signal for driving the gate driver and the source driver; and a power supply circuit including a differential amplifier circuit, a source follower circuit, and a current amplifier circuit including a common source amplifier circuit, a first current source circuit, and a second current source circuit. In the liquid crystal display device, the power supply circuit is a circuit for controlling a potential of the counter electrode, and the common source amplifier circuit is a circuit for amplifying a current depending on the amount of current flowing through the first current source circuit in the image control signal output period, and amplifying a current depending on the amount of current flowing through the second current source circuit in the image control signal stop period.

In the liquid crystal display device according to the embodiment, the first current source circuit and the second current source circuit are connected to a control circuit for a current source circuit for making the amount of current flowing through the first current source circuit different from the amount of current flowing through the second current source circuit and operating the first current source circuit or the second current source circuit.

In the liquid crystal display device according to the embodiment, the display control circuit may include a memory circuit, a comparison circuit, a control signal output circuit, and a selection circuit.

In the liquid crystal display device according to the embodiment, a pixel including the pixel electrode may include a transistor, and a semiconductor film of the transistor may be an oxide semiconductor.

According to one embodiment of the present invention, low power consumption in a power supply circuit of a liquid crystal display device can be achieved when a moving image and a still image are displayed by switching a refresh rate in a control circuit of the liquid crystal display device.

DETAILED DESCRIPTION OF THE INVENTION

Figure 1A:
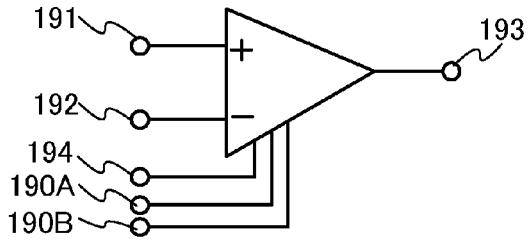
FIGS. 1A to 1C are diagrams illustrating a circuit configuration of Embodiment 1.

Embodiments of the present invention will be described below with reference to the accompanying drawings. However, the present invention can be carried out in many different modes, and it is easily understood by those skilled in the art that modes and details of the present invention can be modified in various ways without departing from the purpose and the scope of the present invention. Therefore, the present invention is not interpreted as being limited to the description of the embodiments below. Note that identical portions or portions having the same function in all drawings illustrating the structure of the present invention that are described below are denoted by the same reference numerals.

Note that the size, the thickness of a layer, distortion of the waveform of a signal, and a region of each structure illustrated in the drawings and the like in the embodiments are exaggerated for simplicity in some cases. Therefore, embodiments of the present invention are not limited to such scales.

Note that in this specification, terms such as "first", "second", "third", and "N-th" (N is a natural number) are used in order to avoid confusion among components and do not limit the number. The natural number is 1 or more unless otherwise specified.

[Embodiment 1]

An example of a circuit configuration of an operational amplifier in a power supply circuit in this embodiment will be described.

Figure 15A:
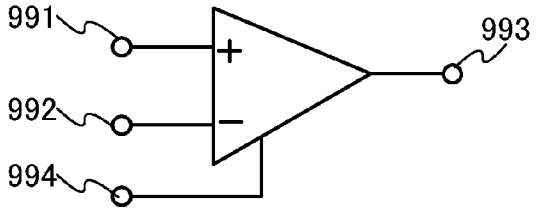
FIGS. 15A and 15B are diagrams illustrating a circuit configuration of an operational amplifier.

FIG. 1A illustrates a circuit symbol of an operational amplifier, and each terminal is denoted by a reference numeral. In FIG. 1A, the operational amplifier includes a non-inverting input terminal 191, an inverting input terminal 192, an output terminal 193, a bias voltage input terminal 194, a bias voltage input terminal 190A for a first current source circuit, and a bias voltage input terminal 190B for a second current source circuit. The circuit symbols illustrated in FIG. 1A are different from the circuit symbols of the operational amplifier described in FIG. 15A. In FIG. 1A, the bias voltage input terminal 190A for a first current source circuit and the bias voltage input terminal 190B for a second current source circuit are included so that a current that flows through a common source amplifier circuit provided in a current amplifier circuit of the operational amplifier in displaying a moving image is made to be different from that in displaying a still image.

Figure 1B:
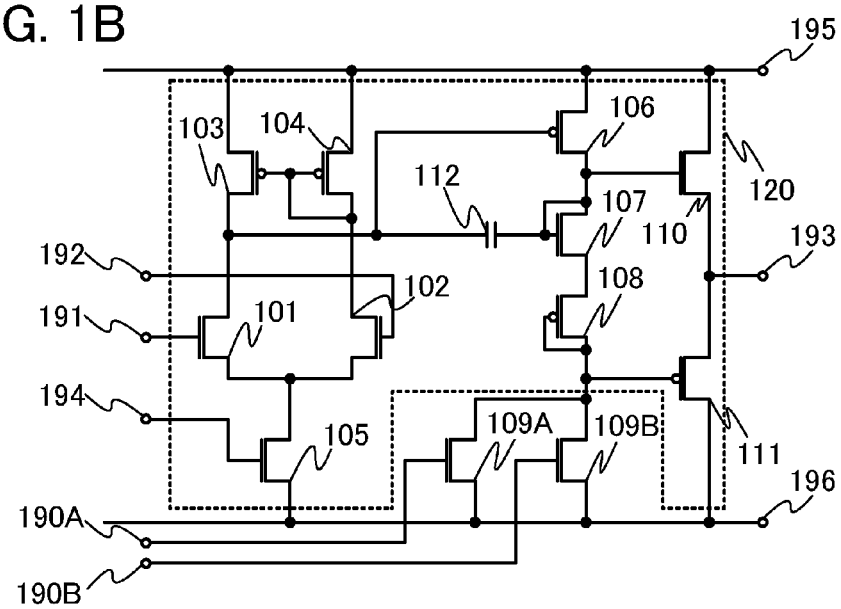

FIG. 1B is an equivalent circuit diagram of the operational amplifier illustrated in FIG. 1A. The operational amplifier includes a differential circuit including a transistor 101 and a transistor 102; a current mirror circuit including a transistor 103 and a transistor 104; a current source circuit including a transistor 105; a current source circuit including a transistor 109A; a current source circuit including a transistor 109B; the common source amplifier circuit including a transistor 106; an idling circuit including a transistor 107 and a transistor 108; a source follower circuit including a transistor 110 and a transistor 111; and a phase compensation capacitor 112. The transistors 103, 104, 106, and 110 are connected to a high power supply voltage side terminal 195; and the transistors 105, 109A, 109B, and 111 are connected to a low power supply voltage side terminal 196. Not that in FIG. 1B, the operational amplifier also includes the non-inverting input terminal 191, the inverting input terminal 192, the output terminal 193, the bias voltage input terminal 194, the bias voltage input terminal 190A for a first current source circuit, and the bias voltage input terminal 190B for a second current source circuit, which are described in FIG. 1A.

Figure 15B:
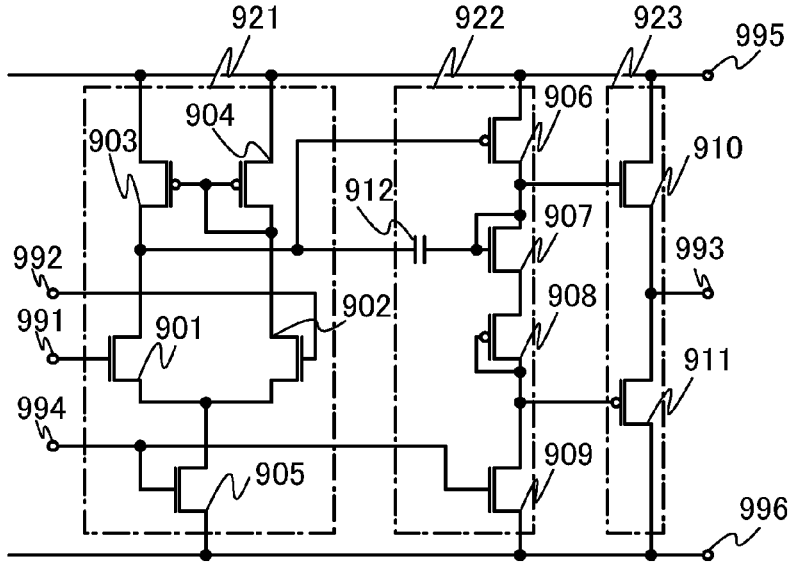

Note that in FIG. 1B as well as FIG. 15B, the differential circuit, the current mirror circuit, and the current source circuit including the transistor 105 are collectively referred to as a differential amplifier circuit. In addition, the common source amplifier circuit, the idling circuit, the current source circuit including the transistor 109A (referred to as a first current source circuit), and a current source circuit including the transistor 109B (referred to as a second current source circuit) are collectively referred to as a current amplifier circuit. Further, the transistors 110 and 111 are collectively referred to as a source follower circuit. Note that in the following description with reference to FIG. 1B, portions similar to those of the circuit configuration of the operational amplifier described in FIG. 15B are described by being collectively abbreviated to a signal input/output circuit 120.

In the circuit configuration illustrated in FIG. 1B, an n-type transistor is included in the differential circuit and a p-type transistor is included in the current mirror circuit. This is also the same in the structure where a polarity of each transistor and a polarity of a signal input into each terminal are reversed.

In the configuration of FIG. 1B, a type of a transistor that can be applied to each transistor is not limited. It is thus possible to apply a thin film transistor (TFT) using a non-single crystal semiconductor film typified by amorphous silicon and polycrystalline silicon, a transistor using a semiconductor substrate or an SOI substrate, a MOS transistor, a junction type transistor, a bipolar transistor, or the like.

Figure 3A:
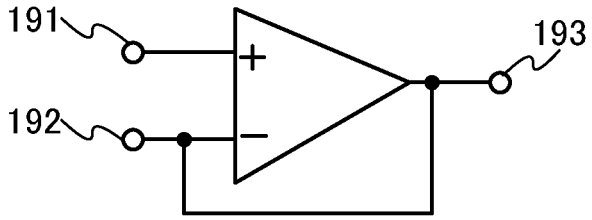
FIGS. 3A and 3B are diagrams illustrating circuit configurations of Embodiment 1.
Figure 3B:
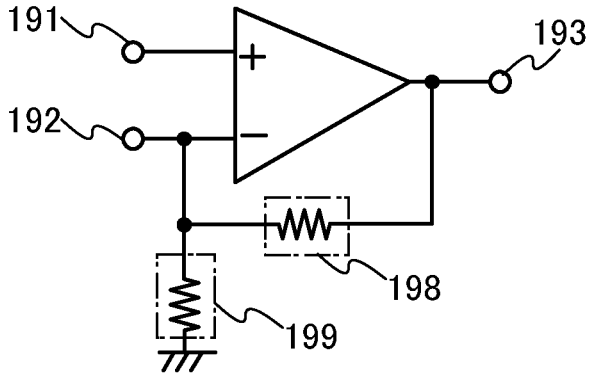

Note that the operational amplifier illustrated in FIGS. 1A and 1B can serve as a power supply circuit by connecting the output terminal 193 to the inverting input terminal 192 in a negative feedback arrangement as illustrated in FIG. 3A. In an example shown in FIG. 3A, a voltage level of a reference power supply which is input to the non-inverting input terminal 191 can be output without change from the output terminal. In the case where an n times (n is a positive integer) voltage is output from the output terminal, as illustrated in FIG. 3B, the voltage level of the output terminal 193 may be divided into two resistors, here a resistor 198 and a resistor 199, in which a resistance ratio of the resistor 198 to the resistor 199 is 1:n−1, and the resistors may be connected to the inverting input terminal 192. In such a manner, a power supply circuit whose current supply capability is high can be formed by increasing the output voltage of the output terminal 193 by n times of the reference voltage.

Note that a reference power supply generation circuit such as a band gap regulator may be used for the reference power supply which is input into the non-inverting input terminal 191 illustrated in FIGS. 3A and 3B. The band gap regulator, whose temperature coefficient is substantially 0, is often used. Not that in FIGS. 3A and 3B, the bias voltage input terminal 190A for a first current source circuit and the bias voltage input terminal 190B for a second current source circuit are omitted.

Figure 1C:
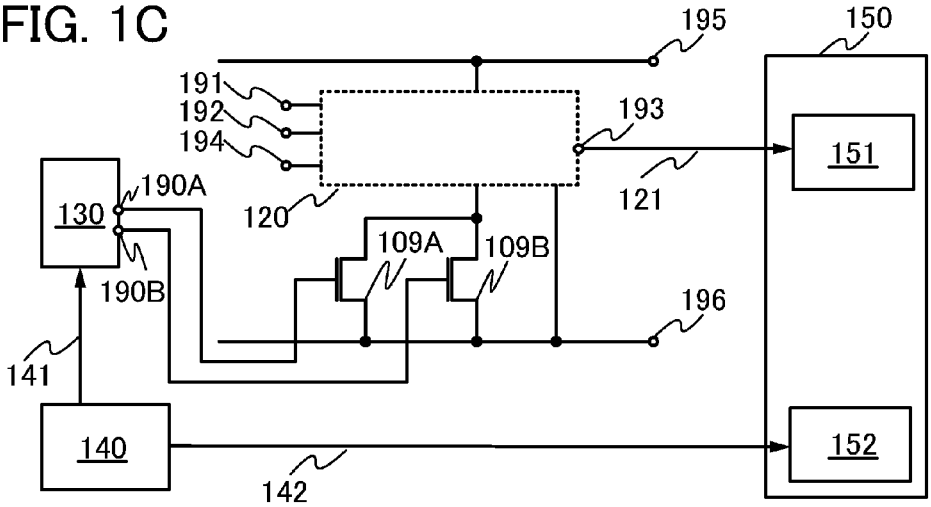

FIG. 1C is a circuit diagram in which peripheral circuits and the like of the operational amplifier illustrated in FIG. 1B are also illustrated. Specifically, FIG. 1C illustrates a control circuit for a current source circuit 130, a display control circuit 140, and a liquid crystal display panel 150, in addition to the operational amplifier. The liquid crystal display panel 150 includes a counter electrode 151 and a pixel circuit 152 including a pixel electrode.

Note that a signal for controlling the current source circuit control circuit 130 is supplied from the display control circuit 140 to the current source circuit control circuit 130 depending on whether an image displayed on the liquid crystal display panel 150 is a moving image or a still image (an arrow 141).

Note that signals, which are supplied to control either the transistor 109A or the transistor 109B so that the transistor functions as the current source circuit of the current amplifier circuit, are supplied from the current source circuit control circuit 130 to the transistors 109A and 109B through the bias voltage input terminal 190A for a first current source circuit and the bias voltage input terminal 190B for a second current source circuit. The current source circuit control circuit 130 controls either the transistor 109A or the transistor 109B so that the transistor functions as the current source circuit depending on a signal from the display control circuit 140. Then, a current that flows through the common source amplifier circuit provided in the current amplifier circuit of the operational amplifier in displaying a moving image can be made to be different from that in displaying a still image by the signal supplied from the display control circuit 140.

Note that a signal for driving the pixel circuit 152 is supplied from the display control circuit 140 to the pixel circuit 152 depending on whether an image displayed on the liquid crystal display panel 150 is a moving image or a still image (an arrow 142).

Note that a common voltage is supplied from the signal input/output circuit 120 to the counter electrode 151 through the output terminal 193 (an arrow 121).

Figure 2A:
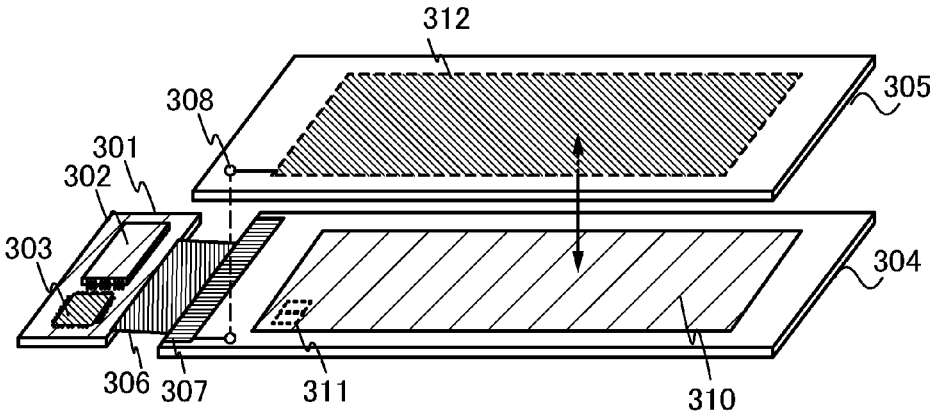
FIGS. 2A and 2B are a perspective view and a circuit configuration of Embodiment 1.
Figure 2B:
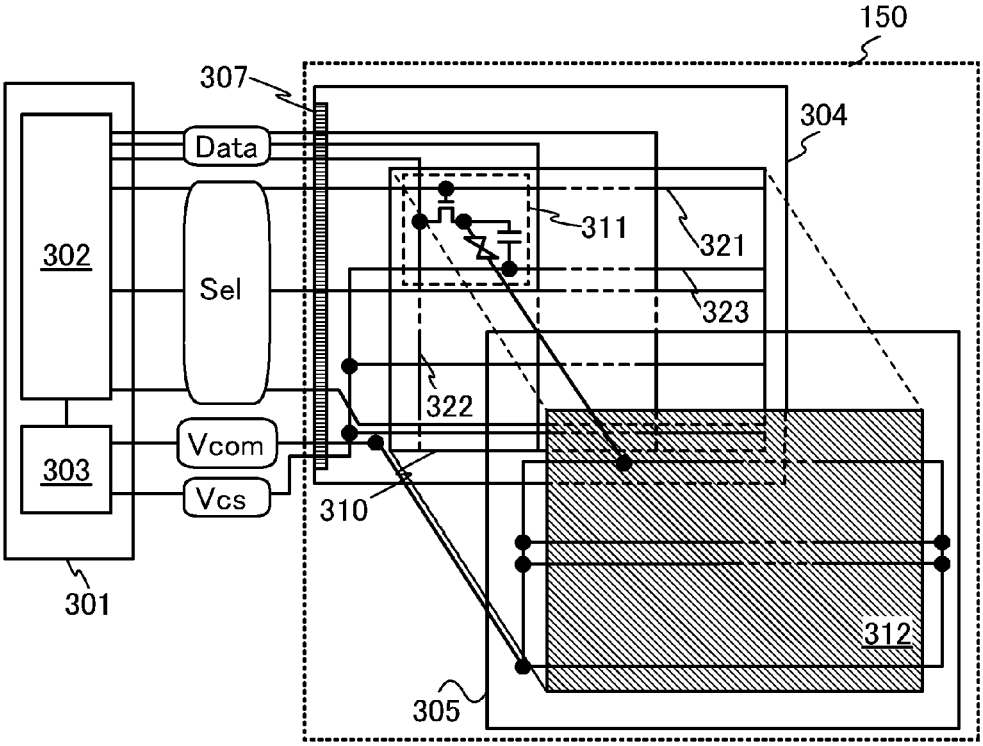

Next, FIG. 2A is a perspective view in which peripheral circuits of the operational amplifier in the power supply circuit illustrated in FIGS. 1A to 1C are illustrated in addition to the operational amplifier, and FIG. 2B illustrates a specific configuration of the liquid crystal display panel 150.

In FIG. 2A, a display control circuit 302 and a power supply circuit 303 are provided over an external substrate 301.

In FIG. 2A, a pixel portion 310 provided with a plurality of pixel circuits 311 is provided over a first display substrate 304 which forms the liquid crystal display panel 150. Note that signals for driving the pixel circuits 311 is supplied to the pixel circuit 311 through an external connection wiring 306 and an external connection terminal 307.

In FIG. 2A, a second display substrate 305 which forms the liquid crystal display panel 150 is provided with a counter electrode 312. Note that a common voltage is supplied from the power supply circuit 303 to the counter electrode 312 through the external connection wiring 306, the external connection terminal 307, and a common connection portion 308 (also referred to as a common contact portion).

In addition, in FIG. 2A, liquid crystal molecules (not shown) are interposed between the pixel electrode of the pixel portion 310 and the counter electrode 312, whereby the orientation of the liquid crystal molecules is controlled in accordance with the electric field between the two electrodes.

FIG. 2B illustrates the configuration of the first display substrate 304 and the second display substrate 305 which correspond to the liquid crystal display panel 150 in FIG. 2A and signals each supplied from the external substrate 301 to the liquid crystal display panel 150.

The first display substrate 304 illustrated in FIG. 2B includes the plurality of pixel circuits 311 in the pixel portion 310. The plurality of pixel circuits 311 is connected to gate lines 321, source lines 322, and capacitor lines 323 which are provided in a matrix. In addition, the second display substrate 305 illustrated in FIG. 2B includes the counter electrode 312 provided on the entire surface.

A selection signal (Sel) for selecting a gate line is supplied from the display control circuit 302 to the gate line 321 illustrated in FIG. 2B. In addition, an image signal (Data) which is input into each pixel circuit 311 is supplied from the display control circuit 302 to the source line 322 illustrated in FIG. 2B. A capacitor voltage (Vcs) is supplied from the power supply circuit 303 to the capacitor line 323 illustrated in FIG. 2B. A common voltage (Vcom) is supplied from the power supply circuit 303 to the counter electrode 312 illustrated in FIG. 2B. Note that the selection signal (Sel), the image signal (Data), and the capacitor voltage (Vcs) are supplied through an external connection wiring (the external connection wiring 306 in FIG. 2A) and the external connection terminal 307. The common voltage (Vcom) is supplied through the external connection wiring (the external connection wiring 306 in FIG. 2A), the external connection terminal 307, and a common connection portion (the common connection portion 308 in FIG. 2A).

Note that the selection signal (Sel) and the image signal (Data) are signals which are generated from a gate driver and a source driver provided in the display control circuit 302. In this embodiment, the selection signal (Sel) and the image signal (Data) are also collectively referred to as an image control signal. The image control signal corresponds to the signal supplied in the direction of the arrow 142 which is described above in FIG. 1C.

In the case where a moving image is displayed in the liquid crystal display panel, the image control signal is to be output successively from the display control circuit 302 in order to update a voltage of the pixel electrode as needed. In the case where a still image is displayed in the liquid crystal display panel by reducing a refresh rate, the image control signal is to be output intermittently from the display control circuit 302 in order to update a voltage of the pixel electrode every fixed period.

In the case where a still image is displayed in the liquid crystal display panel having the configuration of this embodiment by reducing a refresh rate, a voltage of the pixel electrode is updated every fixed period. In other words, since the voltage of the pixel electrode is not updated during a fixed period, it is important to hold the voltage of the pixel electrode during a fixed period. For example, a leakage current is reduced when a transistor which is a switching element provided in the pixel circuit is turned off, and/or the amount of electrostatic capacitance of a capacitor for holding the voltage of the pixel electrode provided in the pixel circuit may be designed large.

Note that the gate driver and the source driver which generate the image control signal operate by a timing signal such as a clock signal and a start pulse signal. When a still image is displayed in the liquid crystal display panel by reducing a refresh rate, input of the timing signal into the gate driver and the source driver can be stopped intermittently, and the image control signal can be intermittently output from the display control circuit 302. As a result, the gate driver and the source driver can be temporarily stopped and thus low power consumption of the gate driver and the source driver can be achieved.

Note that in the following description, a period during which the image control signals are successively output in order to display a moving image is referred to as an image control signal output period. In addition, a period during which the image control signal is stopped in order to display a still image, that is, a period during which input of the timing signals into the gate driver and the source driver is stopped is referred to as an image control signal stop period.

Note that in a period during which a still image is displayed, the image control signal is to be output to the liquid crystal display panel even in the case where image signals having the same voltage are written regularly in order to refresh the voltage held in the pixel electrode. Therefore, a period during which the image control signal is output from the display control circuit 302 can also be referred to as an image control signal output period, and a period during which the image control signal is not output from the display control circuit 302 can also be referred to as an image control signal stop period.

An operation of the circuit in FIGS. 1B and 1C will be briefly described. When an H-level signal is input into the non-inverting input terminal 191, the drain current of the transistor 101 becomes larger than the drain current of the transistor 102. This is because the current source circuit including the transistor 105 is connected to sources of the transistors 101 and 102 included in the differential circuit. Since the transistor 104 and the transistor 103 are included in the current mirror circuit, the drain current of the transistor 103 comes to be equal to the drain current of the transistor 102. Thus, a difference (different current) between the drain current of the transistor 103 and the drain current of the transistor 101 is generated. The gate potential of the transistor 106 is lowered by a different current between the drain current of the transistor 103 and the drain current of the transistor 101. The transistor 106 is a p-type transistor; therefore, the drain current is increased when the gate potential of the transistor 106 is lowered. The drain current of the transistor 106 is changed depending on a current that flows through either the first current source circuit 109A or the second current source circuit 109B. Thus, the gate potential of the transistor 110 is raised by a current that flows through the common source amplifier circuit including the transistor 106 and therefore the source potential of the transistor 110, that is, the output voltage of the output terminal 193 is also raised. Note that the same operation is performed even when an L-level signal is input into the inverting input terminal 192.

When an L-level signal is input into the non-inverting input terminal 191, the drain current of the transistor 101 becomes smaller than the drain current of the transistor 102. This is because the current source circuit including the transistor 105 is connected to sources of the transistors 101 and 102 included in the differential circuit. Since the transistor 104 and the transistor 103 are included in the current mirror circuit, the drain current of the transistor 103 comes to be equal to the drain current of the transistor 102. Thus, a difference (different current) between the drain current of the transistor 103 and the drain current of the transistor 101 is generated. The gate potential of the transistor 106 is raised by a different current between the drain current of the transistor 103 and the drain current of the transistor 101. The transistor 106 is a p-type transistor; therefore, the drain current is decreased when the gate potential of the transistor 106 is raised. The drain current of the transistor 106 is changed depending on a current that flows through either the first current source circuit 109A or the second current source circuit 109B. Thus, the gate potential of the transistor 110 is lowered by a current that flows through the common source amplifier circuit including the transistor 106 and therefore the source potential of the transistor 110, that is, the output voltage of the output terminal 193 is also lowered. Note that the same operation is performed even when an H-level signal is input into the inverting input terminal 192.

The characteristic point of the operation described above in FIGS. 1B and 1C is that a drain current that flows through the transistor 106 for amplifying a current is changed depending on current that flows through either the first current source circuit 109A or the second current source circuit 109B. Specifically, in the image control signal output period during which a moving image is displayed, the first current source circuit through which a current larger than that of the second current source circuit is made to flow is selected; and in the image control signal stop period during which a still image is displayed, the second current source circuit through which a current smaller than that of the first current source circuit is made to flow is selected. Note that other operations are similar to those of FIG. 15B.

In the circuits of FIGS. 1B and 1C, as described above, either the first current source circuit or the second current source circuit operates so that a predetermined current flows therethrough depending on whether the image displayed on the liquid crystal display panel is a moving image or a still image. Specifically, in the image control signal output period during which a moving image is displayed, the current amplification factor of the common source amplifier circuit including the transistor 106 is controlled by the current that flows through the first current source circuit including the transistor 109A. In the image control signal stop period during which a still image is displayed, the current amplification factor of the common source amplifier circuit including the transistor 106 is controlled by the current that flows through the second current source circuit including the transistor 109B, which is different from the current that flows through the first current source circuit. Then, a current that flows through the transistor 106 which is the common source amplifier circuit provided in the current amplifier circuit of the operational amplifier in displaying a moving image can be made to be different from that in displaying a still image by the signal supplied from the display control circuit 140.

Even when a current is made to flow through either the first current source circuit or the second current source circuit, a power supply circuit in which the level of the voltage to be output is equivalent to the level of the voltage of an input signal can be obtained by connecting the output terminal 193 to the inverting input terminal 192 of the operational amplifier in a negative feedback arrangement. In this case, difference lies in the amount of current that flows through the first current source circuit or the second current source circuit, that is, the current supply capability of the output terminal of the operational amplifier. As described above, in displaying a moving image or a still image, either the first current source circuit or the second current source circuit operates by switching the current supply capability which is needed, whereby a consumption current that flows through the current source circuits of the current amplifier circuit can be reduced. Accordingly, low power consumption in the power supply circuit can be achieved.

Note that even in the case of the operation of inputting an L-level signal into the non-inverting input terminal 191 and the operation of inputting an H-level signal into the inverting input terminal 192, either the first current source circuit or the second current source circuit may be made to operate so that a predetermined current flow therethrough, whereby the current supply capability of the output terminal of the operational amplifier is made to be different.

The operations of switching the above first current source circuit and second current source circuit will be described with reference to a flow chart illustrated in FIG. 4.

Figure 4:
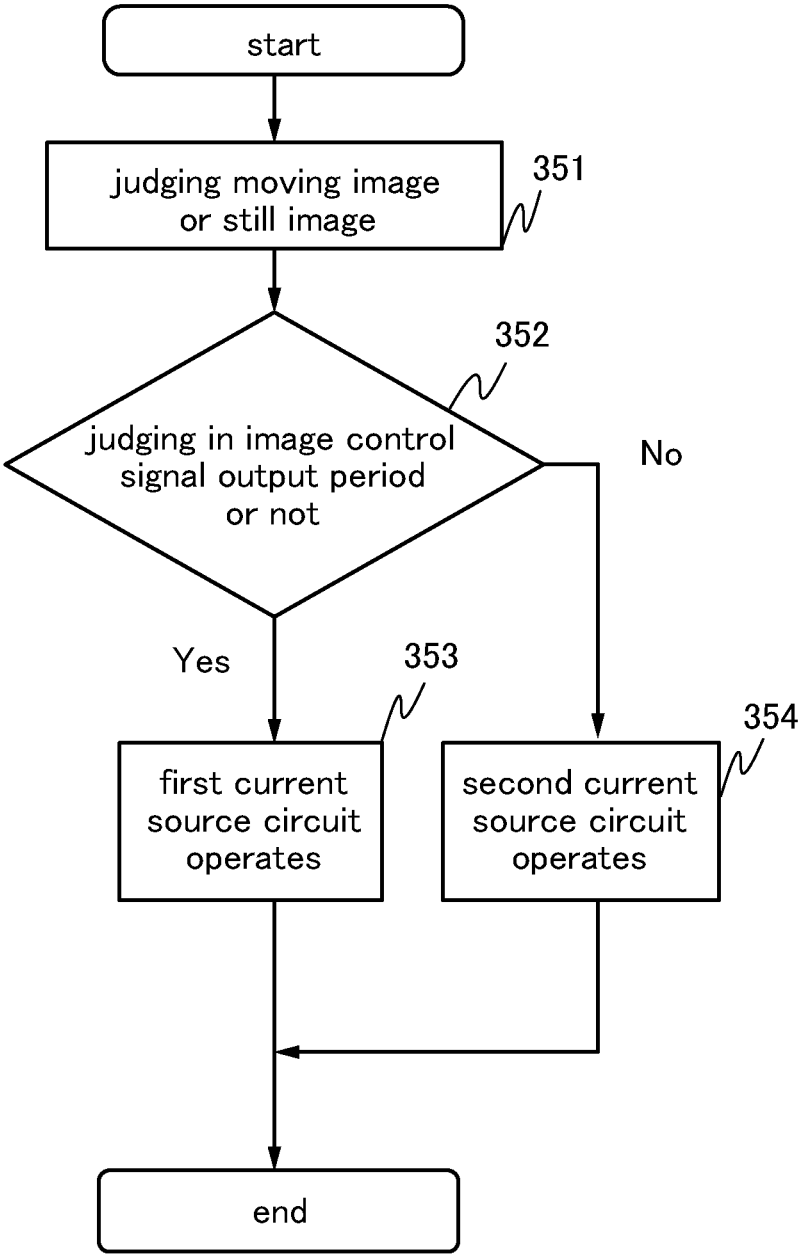
FIG. 4 is a diagram illustrating a timing chart of Embodiment 1.

In a first step 351 in FIG. 4, whether an image signal which is input into the display control circuit is for a moving image or a still image is judged. For example, by comparing the image signals in successive frames, whether a moving image or a still image is displayed is judged, and whether the image signals are in the image control signal output period during which a moving image is displayed or the image control signal stop period during which a still image is displayed is judged. Alternatively, the display control circuit may judge whether a moving image or a still image is displayed in accordance with the kind of inputted image signals. For example, whether a moving image or a still image is displayed may be judged with reference to the file format of electronic data which is the source of an image signal. Alternatively, as long as the display control circuit switches moving image display and still image display in accordance with a switch signal from the outside, the display control circuit may judge whether a moving image or a still image is displayed in accordance with the switch signal.

The processes of a first branch step 353 and a second branch step 354 branch from a second step 352 depending on whether the judgment in the first step 351 is in the image control signal output period or not.

In the case where the second step 352 is in the image control signal output period, the first current source circuit operates so that a current is made to flow therethrough in the first branch step 353.

In the case where the second step 352 is not in the image control signal output period, the second current source circuit operates so that a current is made to flow therethrough in the second branch step 354.

As illustrated in FIG. 4, in the control circuit of the liquid crystal display device described in this embodiment, the first current source circuit or the second current source circuit in the current amplifier circuit of the operational amplifier in the power supply circuit operates selectively. In the common source amplifier circuit included in the current amplifier circuit in the operational amplifier of the power supply circuit, a current is amplified in the image control signal output period in accordance with the amount of current that flows through the first current source circuit, and a current is amplified in the image control signal stop period in accordance with the amount of current that flows through the second current source circuit. Then, a current that flows through the common source amplifier circuit provided in the current amplifier circuit of the operational amplifier in displaying a moving image can be made to be different from that in displaying a still image.

Next, a specific configuration of the current source circuit control circuit 130 illustrated in FIG. 1C will be described with reference to FIGS. 5A and 5B. Here, two examples of the circuit configuration will be described.

Figure 5A:
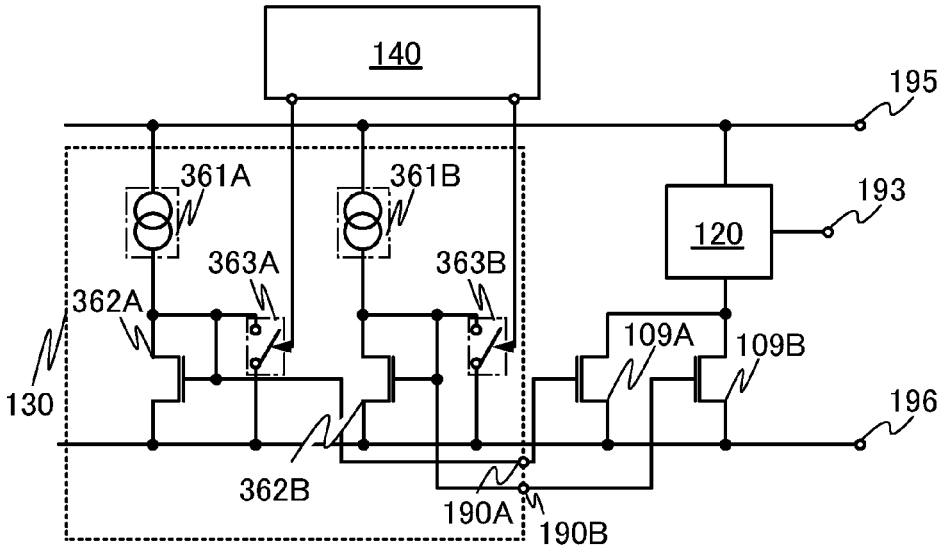
FIGS. 5A and 5B are diagrams illustrating circuit configurations of Embodiment 1.

A control circuit for a current source circuit 130 illustrated in FIG. 5A includes a first current source circuit 361A, a first transistor 362A, a first switch 363A, a second current source circuit 361B, a second transistor 362B, and a second switch 363B.

An operation of the current source circuit control circuit 130 illustrated in FIG. 5A will be briefly described. Note that the levels of the currents that flow through the first current source circuit 361A and the second current source circuit 361B are the same in the following description. The first transistor 362A and the transistor 109A illustrated in FIG. 5A form a current mirror circuit. The second transistor 362B and the transistor 109B illustrated in FIG. 5A form another current mirror circuit. In other words, the same level of current can be made to flow through the first transistor 362A and the second transistor 362B. Therefore, the ratio of a current that flows through the transistor 109A and a current that flows through the transistor 109B can be made to be different by making the transistor 109A and the transistor 109B different in channel width. Further, the display control circuit controls on or off of the first switch 363A and the second switch 363B by switching them alternately, whereby a current can be made to flow selectively through either the transistor 109A or the transistor 109B.

Although in the above description, the ratio of a current that flows through the transistor 109A and a current that flows through the transistor 109B can be made to be different by making the transistor 109A and the transistor 109B different in channel width, another configuration may be employed. As another example, the ratio of a current that flows through the transistor 109A and a current that flows through the transistor 109B can be made to be different by making the first transistor 362A and the second transistor 362B different in channel width.

Note that on or off of the first switch 363A and the second switch 363B illustrated in FIG. 5A is controlled by the signal (in the direction of the arrow 141) for controlling the current source circuit control circuit 130, which is described above in FIG. 1C.

Figure 5B:
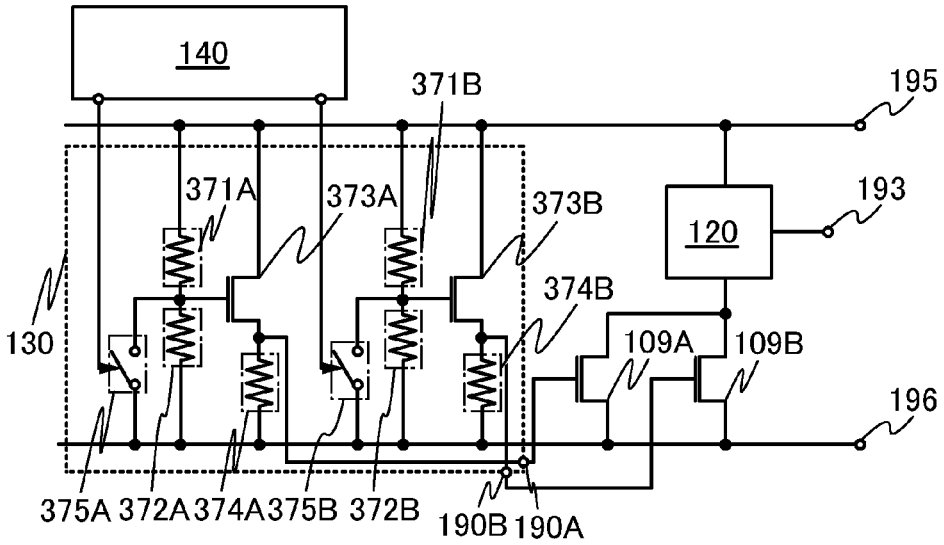

A control circuit for a current source circuit 130 illustrated in FIG. 5B includes a first resistor 371A, a second resistor 372A, a first transistor 373A, a third resistor 374A, a first switch 375A, a fourth resistor 371B, a fifth resistor 372B, a second transistor 373B, a sixth resistor 374B, and a second switch 375B.

An operation of the current source circuit control circuit 130 illustrated in FIG. 5B will be briefly described. A voltage which is applied to a gate of the first transistor 373A is set by the first resistor 371A and the second resistor 372A illustrated in FIG. 5B. In addition, the voltage which is applied to a gate of the second transistor 373B is set by the fourth resistor 371B and the fifth resistor 372B illustrated in FIG. 5B. The voltage which is applied to the gate of the first transistor 373A and the voltage which is applied to the gate of the second transistor 373B are made to be different by having different resistance ratios between the first resistor 371A and the second resistor 372A and between the fourth resistor 371B and the fifth resistor 372B. Further, the ratio of a current that flows through the transistor 109A and a current that flows through the transistor 109B can be changed by applying a voltage which is generated in a node between the first transistor 373A and the third resistor 374A and applying a voltage which is generated in a node between the second transistor 373B and the sixth resistor 374A. Further, the display control circuit controls on or off of the first switch 375A and the second switch 375B by switching them alternately, whereby a current can be made to flow selectively through either the transistor 109A or the transistor 109B.

Note that on or off of the first switch 375A and the second switch 375B illustrated in FIG. 5B is controlled by the signal (in the direction of the arrow 141) for controlling the current source circuit control circuit 130, which is described above in FIG. 1C.

As described above, in one embodiment of the present invention, the current source circuits which are provided in the current amplifier circuit in the operational amplifier operate by switching the current source circuit used for displaying a moving image and the current source circuit used for displaying a still image. The current amplitude in the common source amplifier circuit is controlled by switching the current source circuits so that the current amplitude in displaying a moving image is made to be different from that in displaying a still image, whereby low power consumption in the power supply circuit is achieved. The switching of the current source circuits in the operational amplifier is performed by a display control circuit for controlling the liquid crystal display panel in order to switch moving image display and still image display. As a result, low power consumption in a power supply circuit of a liquid crystal display device can be achieved when a moving image and a still image are displayed by switching a refresh rate in a control circuit of the liquid crystal display device.

This embodiment can be implemented in appropriate combination with the structures described in the other embodiments.

[Embodiment 2]

In this embodiment, specific configurations of the display control circuit 140 illustrated in FIG. 1C and the display control circuit 302 illustrated in FIGS. 2A and 2B, which are in the above embodiment, and timing charts of each circuit will be described with reference to FIG. 6, FIG. 7, FIG. 8, FIGS. 9A and 9B, and FIG. 10.

The display control circuit which will be specifically described in this embodiment outputs an image control signal for writing an image signal in every frame in the case where image signals in successive frames are different from each other (i.e., a moving image is displayed). On the other hand, in the case where image signals in successive frames are the same (i.e., a still image is displayed), supply of an image control signal is stopped and a voltage applied to a liquid crystal element is held by putting the potential of the pixel electrode, which applies the voltage to the liquid crystal, in a floating state; thus, a refresh rate is reduced.

Figure 6:
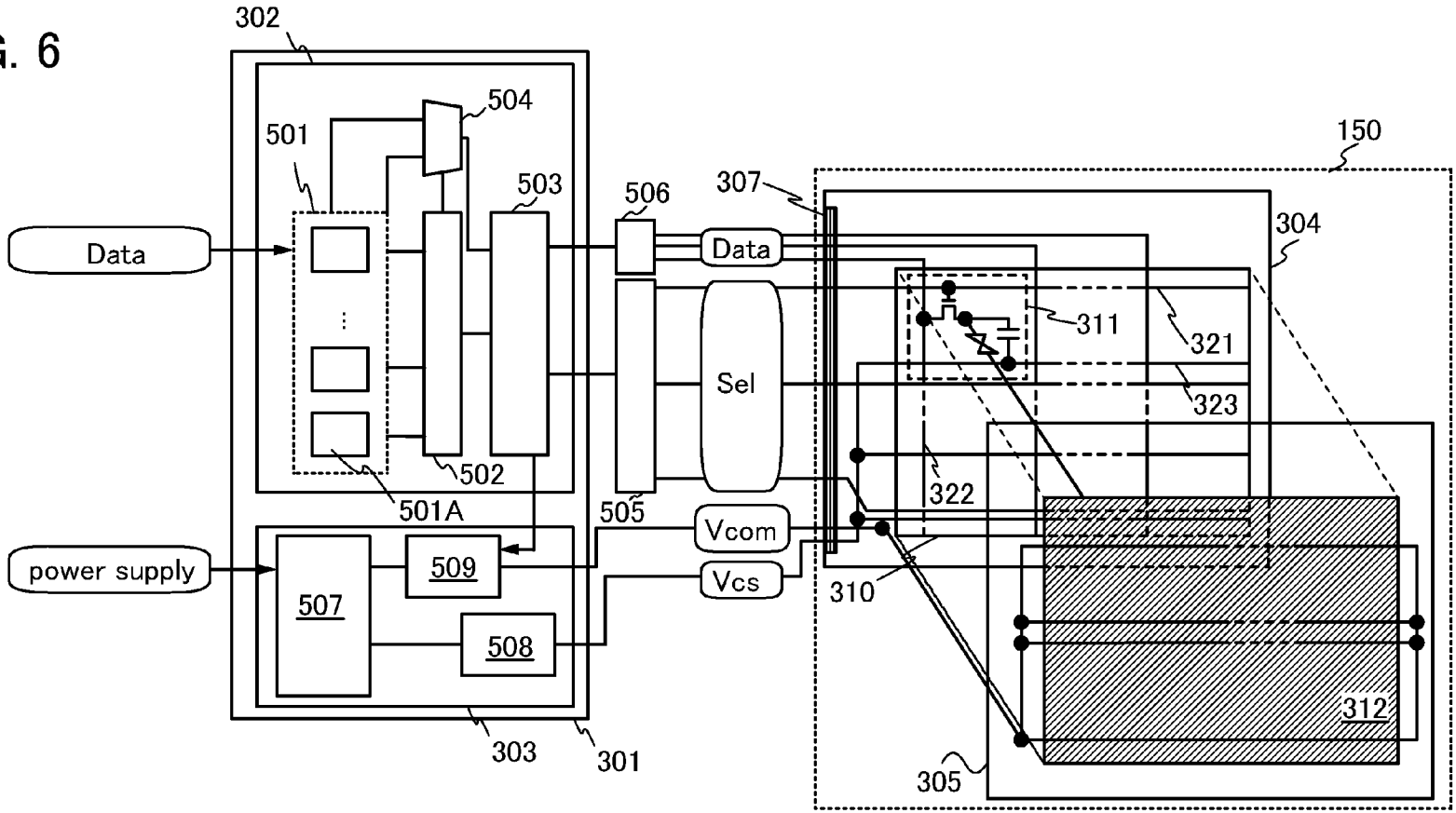
FIG. 6 is a block diagram of Embodiment 2.

The specific configuration of the display control circuit illustrated in FIG. 1C and FIGS. 2A and 2B will be described with reference to a block diagram in FIG. 6. FIG. 6 illustrates a gate driver 505 and a source driver 506; and the liquid crystal display panel 150, and the display control circuit 302 and the power supply circuit 303 over the external substrate 301, which are described by being denoted by reference numerals in FIGS. 2A and 2B. Note that as for the configuration of the liquid crystal display panel 150, the portions are similar to those described by being denoted by reference numerals in FIG. 2B and therefore the description of Embodiment 1 is employed.

Note that although in FIG. 6 the gate driver 505 and the source driver 506 are provided outside the external substrate 301, the gate driver 505 and the source driver 506 may be provided over the external substrate 301.

An image signal (an image signal Data) is supplied from an external device connected to the liquid crystal display device to the display control circuit 302. The display control circuit 302 controls supply or stop of a timing signal to the gate driver 505 and the source driver 506 in accordance with the image signal Data. In addition, a power source is input into the power supply circuit 303, and a plurality of power source voltages for driving the liquid crystal display panel 150 is generated by the power supply circuit 303. The plurality of power source voltages is a high power supply voltage Vdd and a low power supply voltage Vss as well as the capacitor voltage Vcs supplied to the capacitor line 323 and the common voltage Vcom supplied to the counter electrode 312 in the liquid crystal display panel 150.

Next, a configuration of the display control circuit 302 and a procedure in which the display control circuit 302 processes an image signal will be described.

The display control circuit 302 includes a memory circuit 501, a comparison circuit 502, a timing signal output circuit 503, and a selection circuit 504.

The memory circuit 501 includes a plurality of frame memories for storing image signals for a plurality of frames. The number of frame memories included in the memory circuit 501 is not particularly limited as long as the image signals of the plurality of frames can be stored. Note that the frame memory may be formed using a memory element such as dynamic random access memory (DRAM) or static random access memory (SRAM).

Note that the number of frame memories is not particularly limited as long as an image signal can be stored for each frame period. In addition, the image signals stored in the frame memories are selectively read by the comparison circuit 502 and the timing signal output circuit 503. Note that a frame memory 501A in the drawing is schematically illustrated as a memory region of one frame.

The comparison circuit 502 is a circuit that selectively reads image signals in successive frame periods stored in the memory circuit 501, compares the image signals in the successive frame periods in each pixel, and detects a difference thereof.

In this embodiment, depending on whether a difference of image signals between frames is detected or not, operations of the timing signal output circuit 503 and the selection circuit 504 are determined. When a difference is detected between the frames in any of the pixels by the comparison circuit 502 (when there is a difference), the comparison circuit 502 determines that image signals are not for displaying a still image and that successive frame periods between which the difference is detected are periods for displaying a moving image.

On the other hand, when a difference is not detected in any of the pixels by comparing the image signals in the comparison circuit 502 (when there is no difference), the successive frame periods during which the difference is not detected is determined as period during which a still image is to be displayed. That is, the comparison circuit 502 determines whether image signals in the successive frame periods are moving image signals or still image signals by detecting whether or not there is a difference between the image signals.

Note that the criterion of determining that there is a difference by the comparison may be set such that the difference is recognized when the degree of the difference exceeds a certain value. The comparison circuit 502 may be set to detect a difference by the absolute value of the difference.

The selection circuit 504 includes a plurality of switches, for example, switches formed using transistors. In the case where the comparison circuit 502 detects a difference in successive frames, that is, in the case where an image is a moving image, the selection circuit 502 selects an image signal of a moving image from frame memories in the memory circuit 501 and outputs the image signals to the timing signal output circuit 503.

Note that in the case where the comparison circuit 502 does not detect a difference in the successive frame periods, that is, the image is a still image, the selection circuit 504 does not output the image signal to the timing signal output circuit 503 from the frame memories in the memory circuit 501. With the configuration in which an image signal is not output to the timing signal output circuit 503 from the frame memories, power consumption of the external substrate 301 can be reduced.

The timing signal output circuit 503 is a circuit for controlling supply or stop of an image signal which is selected by the selection circuit 504 and a timing signal to the gate driver 505 and the source driver 506.

Next, the configuration of the power supply circuit 303 will be described. Here, the capacitor voltage Vcs supplied to the capacitor line 323 and the common voltage Vcom supplied to the counter electrode 312 in the liquid crystal display panel 150 are described as examples of the plurality of power source voltages which is generated in the power supply circuit.

The power supply circuit 303 includes a reference power supply voltage generation circuit 507, a capacitor voltage generation circuit 508, and a common voltage generation circuit 509.

A band gap regulator or the like may be used for the reference power supply voltage generation circuit 507. The band gap regulator, whose temperature coefficient is substantially 0, is often used.

The capacitor voltage generation circuit 508 includes an operational amplifier and is a circuit for generating the capacitor voltage to be supplied to the capacitor line.

The common voltage generation circuit 509 includes the operational amplifier described in Embodiment 1, in which the first current source circuit and the second current source circuit are switched by the current source circuit control circuit, and is a circuit for generating a common voltage to be supplied to the counter electrode. Note that the current source circuit control circuit included in the common voltage generation circuit 509 is controlled in accordance with judgement whether a moving image or a still image is displayed in the display control circuit 302. Specifically, the current source circuit control circuit included in the common voltage generation circuit 509 is controlled in accordance with supply or stop of an image signal which is selected by the selection circuit 504 in the display control circuit 302 and a timing signal from the timing signal output circuit 503.

Figure 7:
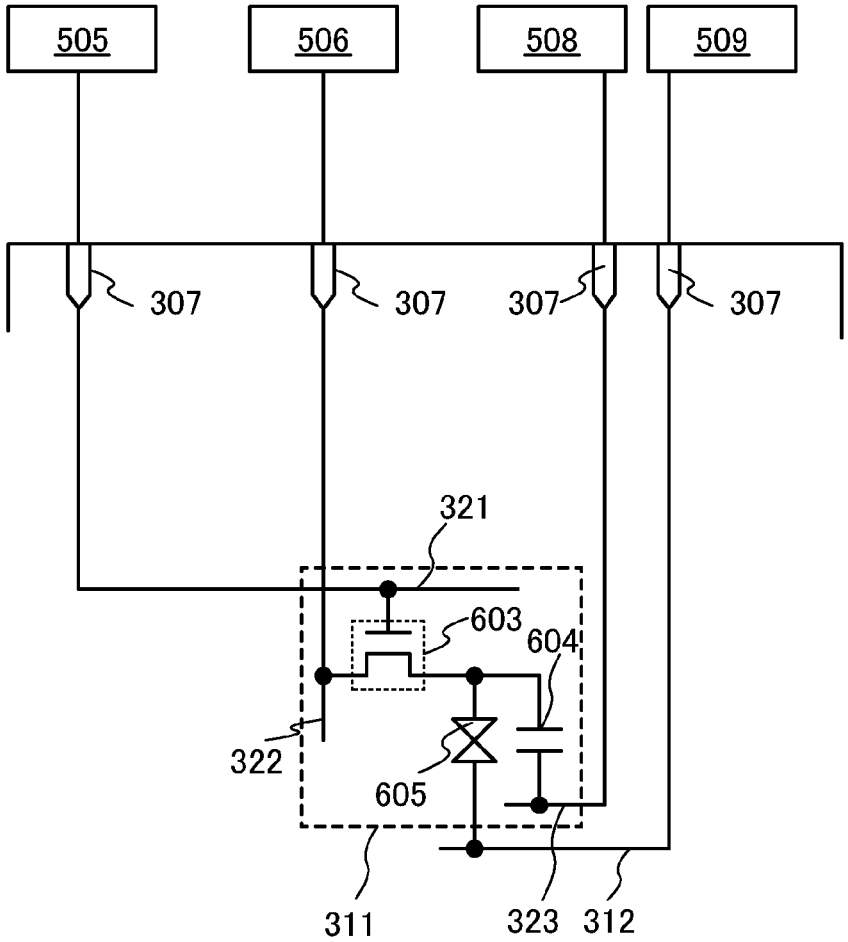
FIG. 7 is a diagram illustrating a circuit configuration of Embodiment 2.

The pixel circuit 311 includes a transistor 603 as a switching element, and a capacitor 604 and a liquid crystal element 605 which are connected to the transistor 603 (see FIG. 7).

As the transistor 603, a transistor having a lower off-state current is used. When the transistor 603 is off, electrical charges accumulated in the capacitor 604 and the liquid crystal element 605 which are connected to the transistor 603 whose off current is reduced are less likely to leak through the transistor 603, and a state where a signal is written before the transistor 603 is off can be held for a long time.

In this embodiment, liquid crystal molecules are controlled by an electric field which is generated by the pixel electrode provided over the first substrate and the counter electrode provided on the second substrate which faces the first substrate.

The gate line 321 is supplied with a selection signal from the gate driver 505 through the external connection terminal 307. The source line 322 is supplied with an image signal from the source driver 506 through the external connection terminal 307. The capacitor line 323 is supplied with a capacitor voltage Vcs from the capacitor voltage generation circuit 508 through the external connection terminal 307. The counter electrode 312 is supplied with a common voltage Vcom from the common voltage generation circuit 509 through the external connection terminal 307.

Next, signals supplied to the pixels are described with reference to a circuit diagram of the liquid crystal display device illustrated in FIG. 7 and a timing chart illustrated in FIG. 8.

Figure 8:
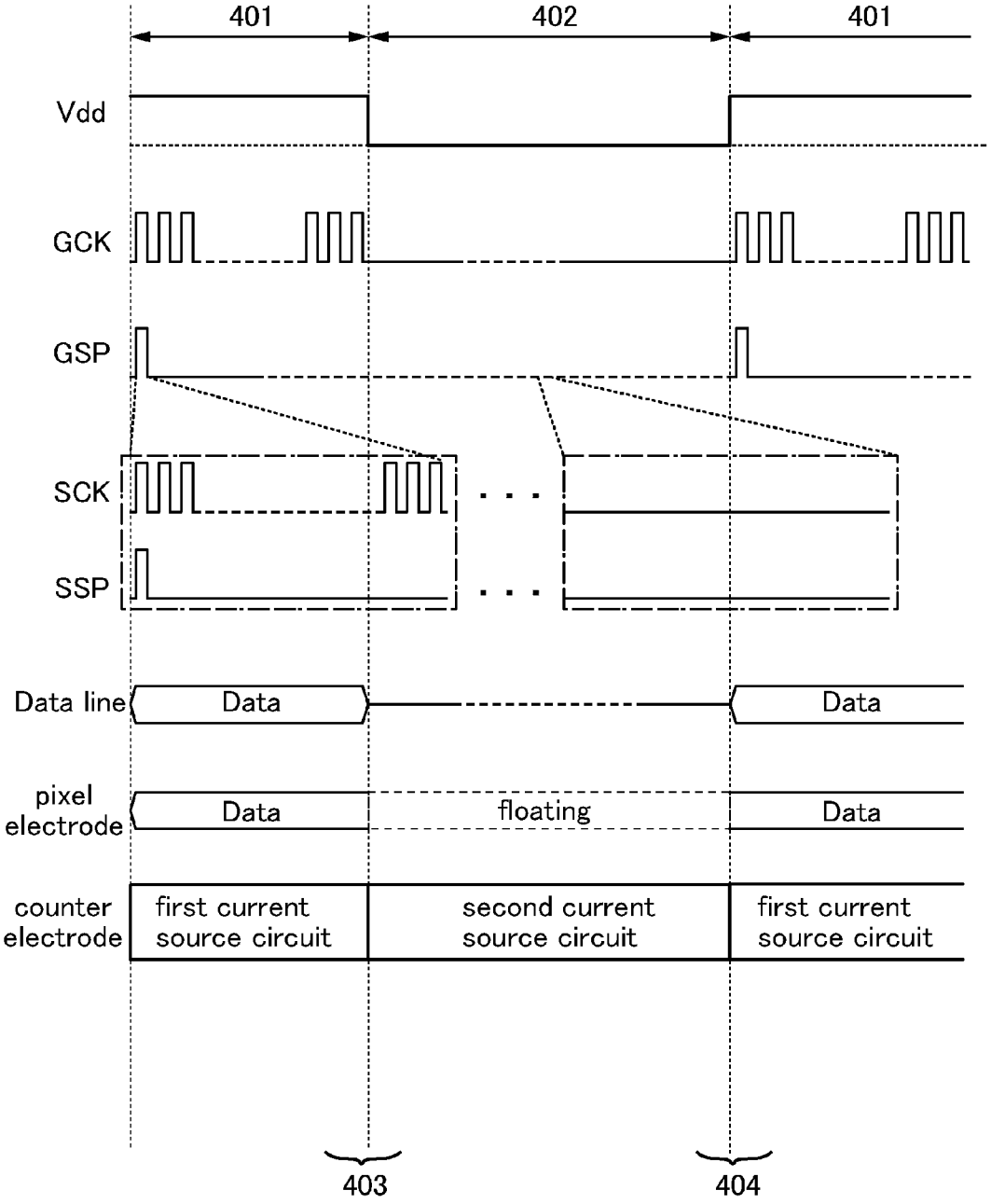
FIG. 8 is a diagram illustrating a timing chart of Embodiment 2.

FIG. 8 illustrates a clock signal GCK and a start pulse GSP which are supplied from the timing signal output circuit 503 to the gate driver 505. In addition, FIG. 8 illustrates a clock signal SCK and a start pulse SSP which are supplied from the timing signal output circuit 503 to the source driver 506. Note that FIG. 8 illustrates a simple square wave as the waveform of the clock signal in order to describe the timing of output of the clock signal.

FIG. 8 also illustrates a state of the source line 322 (Data line), a state of the pixel electrode, and a switching state of the counter electrode.

In FIG. 8, a period 401 corresponds to a period during which image signals for displaying a moving image are written. In the period 401, an operation is performed so that image signals are supplied to the pixels in the pixel portion 310 and the common voltage generated using the first current source circuit in the power supply circuit is supplied to the counter electrode.

Further, a period 402 corresponds to a period during which a still image is displayed. In the period 402, an operation is performed so that image signals are stopped to the pixels in the pixel portion 310 and the common voltage generated using the second current source circuit in the power supply circuit is supplied to the counter electrode.

Note that, although the configuration of FIG. 8 illustrates that each signal is supplied so that the gate driver 505 and the source driver 506 stop operating in the period 402, it is preferable to employ a configuration in which image signals are regularly written in accordance with the length of the period 402 and the refresh rate to prevent deterioration of a still image.

First, the period 401 of the timing chart illustrated in FIG. 8 will be described. In the period 401, a clock signal is always supplied as the clock signal GCK, and a pulse is supplied as the start pulse GSP in accordance with a vertical synchronization frequency. Further, in the period 401, a clock signal is always supplied as the clock signal SCK, and a pulse is supplied as the start pulse SSP in accordance with one gate selection period.

In addition, the image signal Data is supplied to the pixel of each row through the source line 322, and the potential of the image signal Data in the source line 322 is supplied to the pixel electrode in accordance with the potential of the gate line 321.

Further, the timing signal output circuit 503 selects the first current source circuit in the operational amplifier of the common voltage generation circuit 509 and supplies a generated common voltage to the counter electrode.

Next, the period 402 of the timing chart illustrated in FIG. 8 will be described. In the period 402, the clock signal GCK, the start pulse GSP, the clock signal SCK, and the start pulse SSP which serve as timing signals of the gate driver 505 and the source driver 506 are stopped. In addition, in the period 402, the selection signal Sel supplied to the gate line 321 and the image signal Data supplied to the source line 322 are stopped. In the period 402 during which the supply of the clock signal GCK and the start pulse GSP is stopped, the transistor 603 is brought out of electrical conduction and the potential of the pixel electrode is in a floating state.

In other words, in the period 402, the potential of the pixel electrode of the liquid crystal element 605 is put in a floating state; thus, a still image can be displayed without the supply of another potential. Further, the supply of the clock signals and the start pulses to be the timing signals of the gate driver 505 and the source driver 506 are stopped, whereby low power consumption can be achieved.

In particular, when a transistor whose off-state current is low are used for the transistor 603, a decrease over time of the voltage applied to both terminals of the liquid crystal element 605 can be suppressed.

Figure 9A:
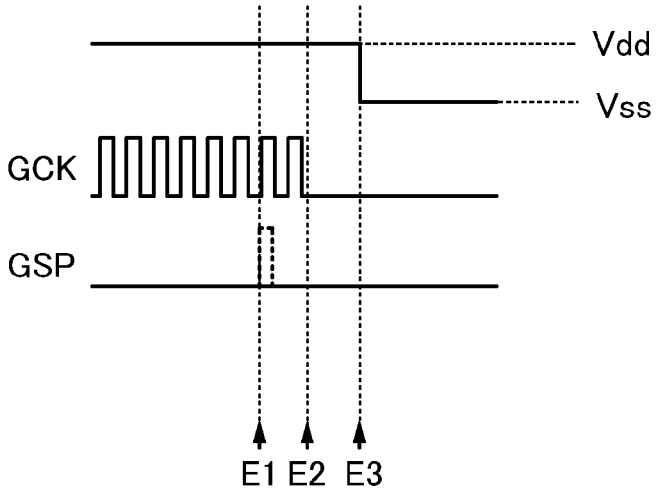
FIGS. 9A and 9B are diagrams illustrating timing charts of Embodiment 2.
Figure 9B:
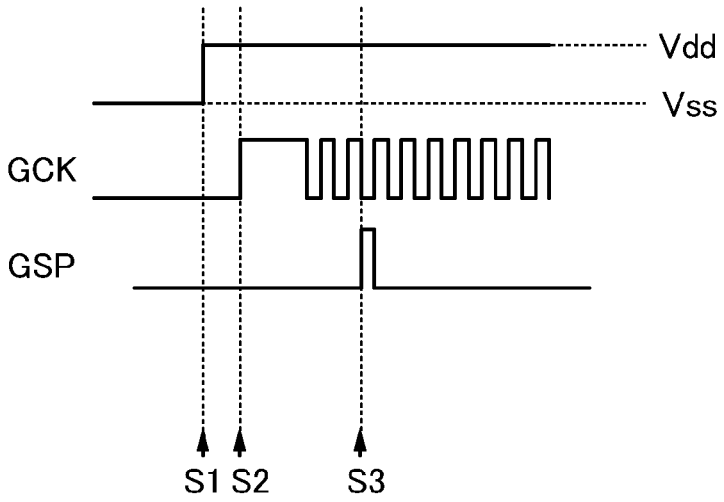

Next, operation of the timing signal output circuit 503 in a period during which a moving image is switched to a still image (a period 403 in FIG. 8) and a period during which a still image is changed to a moving image (a period 404 in FIG. 8) will be described with reference to FIGS. 9A and 9B. FIGS. 9A and 9B illustrate potentials of high power supply potential Vdd, the clock signal (here, GCK), and the start pulse signal (here, GSP) which are output from the timing signal output circuit 503 to the gate driver 505 and the source driver 506.

FIG. 9A illustrates the operation of the timing signal output circuit 503 in the period 403 during which a displayed image is switched from a moving image to a still image. The timing signal output circuit 503 stops supplying the start pulse GSP (E1 in FIG. 9A, a first step). The supply of the start pulse GSP is stopped and then, the supply of a plurality of clock signals GCK is stopped after pulse output reaches the last stage of the shift register (E2 in FIG. 9A, a second step). Then, the potential of the power supply voltage is changed from the high power supply potential Vdd to the low power supply potential Vss (E3 in FIG. 9A, a third step).

Through the above steps, the supply of timing signals to the gate driver 505 and the source driver 506 can be stopped without causing malfunction of the gate driver 505 and the source driver 506. Malfunction in switching a moving image to a still image causes noise, and a still image affected by the noise is held. Therefore, a liquid crystal display device which includes the gate driver 505 and the source driver 506 with fewer malfunctions can display a still image which is not deteriorated so much.

Next, FIG. 9B illustrates the operation of the timing signal output circuit 503 in the period 404 during which a displayed image is switched from a still image to a moving image. The timing signal output circuit 503 changes the potential of the power supply voltage from the low power supply potential Vss to the high power supply potential Vdd (S1 in FIG. 9B, a first step). Then, after an H-level potential is supplied as the clock signal GCK, a plurality of clock signals GCK is supplied (S2 in FIG. 9B, a second step). Next, the start pulse signal GSP is supplied (S3 in FIG. 9B, a third step).

Through the above steps, the supply of timing signals to the gate driver 505 and the source driver 506 can be started again without causing malfunction of the gate driver 505 and the source driver 506. The gate driver 505 and the source driver 506 can be driven without malfunction by sequentially changing potentials of the wirings back to those at the time of displaying a moving image.

Figure 10:
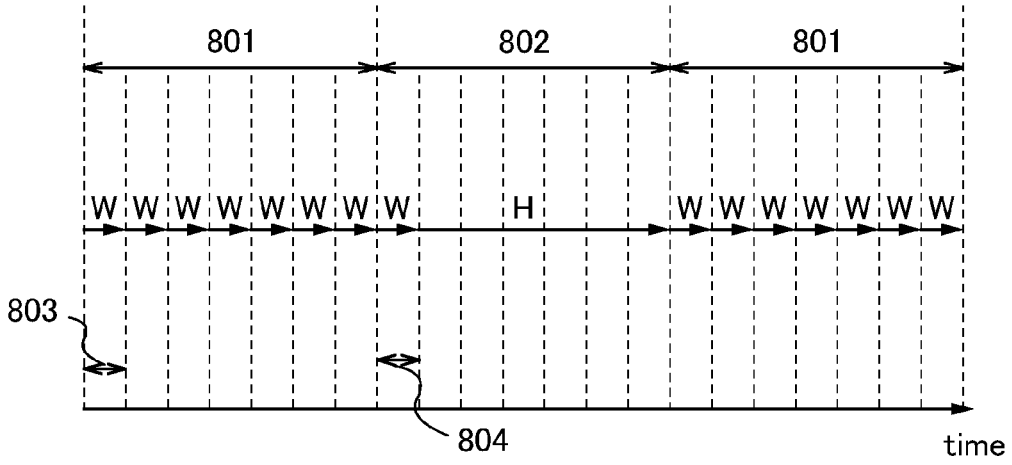
FIG. 10 is a diagram illustrating a timing chart of Embodiment 2.

FIG. 10 schematically illustrates the frequency of writing of image signals in each frame period in a period 801 during which a moving image is displayed and a period 802 during which a still image is displayed. In FIG. 10, "W" indicates a period during which an image signal is written, and "H" indicates a period during which the image signal is held. Although a period 803 indicates one frame period in FIG. 10, the period 803 may be a different period.

In the structure of the liquid crystal display device of this embodiment, an image signal of a still image displayed in the period 802 is written in a period 804, and the image signal written in the period 804 is held in the other period in the period 802.

The liquid crystal display device described in this embodiment as an example can decrease writing frequency of an image signal in a period during which a still image is displayed. As a result, low power consumption at the time of displaying a still image can be achieved.

In the case where the same images are rewritten plural times to display a still image, visual recognition of switching between the images might cause eyestrain. In the liquid crystal display device of this embodiment, the frequency of writing image signals is reduced, whereby there is an advantageous effect of making eyestrain less severe.

This embodiment can be implemented in appropriate combination with the structures described in the other embodiments.

[Embodiment 3]

In this embodiment, a structural example of the transistor of the pixel in the liquid crystal display panel 150 described in Embodiment 1 will be described.

As structural examples of the transistor, transistors each including an oxide semiconductor layer as a semiconductor layer will be described with reference to FIGS. 11A to 11D and FIGS. 12A and 12B. FIGS. 11A to 11D and FIGS. 12A and 12B are cross-sectional schematic views of the transistor.

Figure 11A:
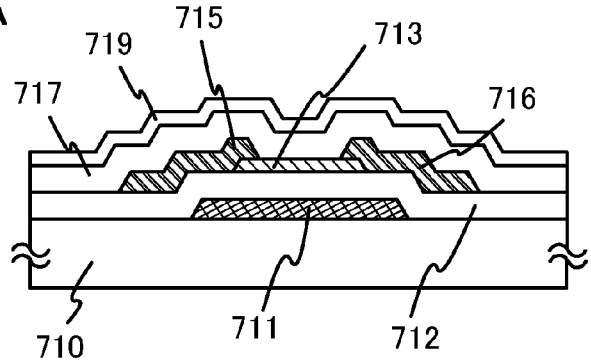
FIGS. 11A to 11D are cross-sectional views illustrating Embodiment 3.

A transistor illustrated in FIG. 11A is a kind of bottom-gate transistor called an inverted-staggered transistor.

The transistor illustrated in FIG. 11A includes a conductive layer 711 provided over a substrate 710, an insulating layer 712 provided over the conductive layer 711, an oxide semiconductor layer 713 provided over the conductive layer 711 with the insulating layer 712 interposed therebetween, and a conductive layer 715 and a conductive layer 716 provided over parts of the oxide semiconductor layer 713.

Further, FIG. 11A illustrates an oxide insulating layer 717 which is in contact with the other part of the oxide semiconductor layer 713 of the transistor (part of the oxide semiconductor layer 713 over which neither the conductive layer 715 nor the conductive layer 716 is provided) and a protective insulating layer 719 provided over the oxide insulating layer 717.

Figure 11B:
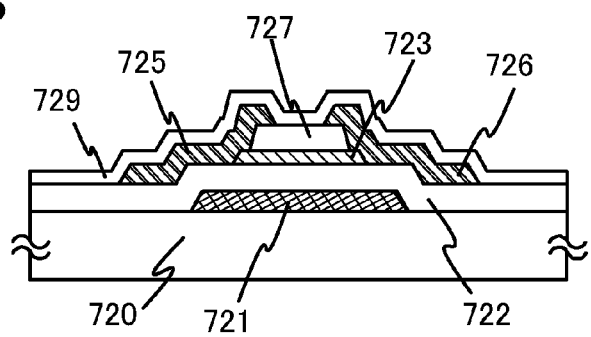

A transistor illustrated in FIG. 11B is a channel protective (also referred to as a channel stop) transistor which is a kind of bottom-gate transistors called an inverted-staggered transistor.

The transistor illustrated in FIG. 11B includes a conductive layer 721 provided over a substrate 720, an insulating layer 722 provided over the conductive layer 721, an oxide semiconductor layer 723 provided over the conductive layer 721 with the insulating layer 722 interposed therebetween, an insulating layer 727 provided over the conductive layer 721 with the insulating layer 722 and the oxide semiconductor layer 723 interposed therebetween, and a conductive layer 725 and a conductive layer 726 provided over parts of the oxide semiconductor layer 723 and parts of the insulating layer 727.

When the conductive layer 721 is overlapped with part of or the entire oxide semiconductor layer 723, light entering the oxide semiconductor layer 723 can be suppressed.

Further, FIG. 11B illustrates a protective insulating layer 729 provided over the transistor.

Figure 11C:
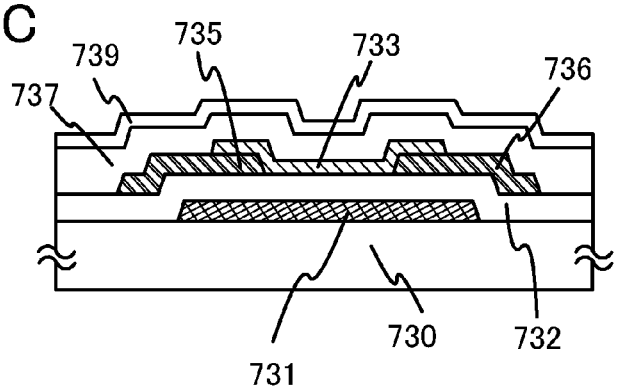

A transistor illustrated in FIG. 11C is a kind of bottom-gate transistor.

The transistor illustrated in FIG. 11C includes a conductive layer 731 provided over a substrate 730, an insulating layer 732 provided over the conductive layer 731, a conductive layer 735 and a conductive layer 736 provided over parts of the insulating layer 732, and an oxide semiconductor layer 733 provided over the conductive layer 731 with the insulating layer 732, the conductive layer 735, and the conductive layer 736 interposed therebetween.

When the conductive layer 731 is overlapped with part of or the entire oxide semiconductor layer 733, light entering the oxide semiconductor layer 733 can be suppressed.

Further, FIG. 11C illustrates an oxide insulating layer 737 which is in contact with an upper surface and a side surface of the oxide semiconductor layer 733 and a protective insulating layer 739 provided over the oxide insulating layer 737.

Figure 11D:
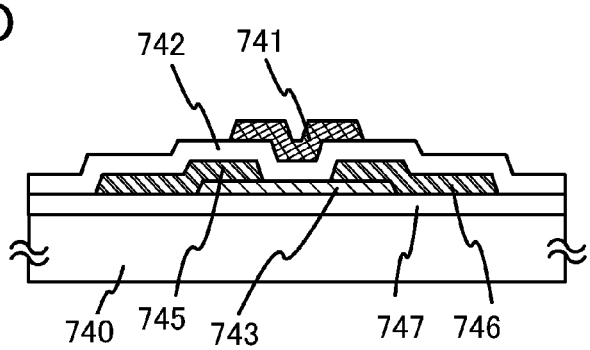

A transistor illustrated in FIG. 11D is a kind of top-gate transistor.

The transistor illustrated in FIG. 11D includes an oxide semiconductor layer 743 provided over a substrate 740 with an insulating layer 747 interposed therebetween, a conductive layer 745 and a conductive layer 746 provided over parts of the oxide semiconductor layer 743, an insulating layer 742 provided over the oxide semiconductor layer 743, the conductive layer 745, and the conductive layer 746, and a conductive layer 741 provided over the oxide semiconductor layer 743 with the insulating layer 742 interposed therebetween.

For example, as the substrate 710, the substrate 720, the substrate 730, and the substrate 740, a glass substrate (e.g., barium borosilicate glass or aluminoborosilicate glass), a substrate formed of an insulator (e.g., a ceramic substrate, a quartz substrate, or a sapphire substrate), a crystallized glass substrate, a plastic substrate, or a semiconductor substrate (e.g., a silicon substrate) is used.

In the transistor illustrated in FIG. 11D, the insulating layer 747 serves as a base layer for preventing diffusion of an impurity element from the substrate 740. The insulating layer 747 can be formed to have a single-layer structure or a stacked-layer structure using one or more of a silicon nitride layer, a silicon oxide layer, a silicon nitride oxide layer, a silicon oxynitride layer, an aluminum oxide layer, and an aluminum oxynitride layer. Alternatively, the insulating layer 747 can be a stack of a layer using a light-blocking material and the above layer. Still alternatively, the insulating layer 747 can be a layer using a light-blocking material. Note that when the insulating layer 747 is formed with a layer using a light-blocking material, light entering the oxide semiconductor layer 743 can be suppressed.

Note that in the transistors illustrated in FIGS. 11A to 11C as well as the transistor illustrated in FIG. 11D, the insulating layer 747 may be provided between the substrate 710 and the conductive layer 711, between the substrate 720 and the conductive layer 721, or between the substrate 730 and the conductive layer 731.

The conductive layers (the conductive layer 711, the conductive layer 721, the conductive layer 731, and the conductive layer 741) each function as a gate of the respective transistors. For example, as each of the conductive layers, a layer of a metal material such as molybdenum, titanium, chromium, tantalum, tungsten, aluminum, copper, neodymium, or scandium, or an alloy material which contains any of the metal materials as its main component is used.

The insulating layers (the insulating layer 712, the insulating layer 722, the insulating layer 732, and the insulating layer 742) each function as a gate insulating layer of the respective transistors.

For example, as each of the insulating layers (the insulating layer 712, the insulating layer 722, the insulating layer 732, and the insulating layer 742), a silicon oxide layer, a silicon nitride layer, a silicon oxynitride layer, a silicon nitride oxide layer, an aluminum oxide layer, an aluminum nitride layer, an aluminum oxynitride layer, an aluminum nitride oxide layer, a hafnium oxide layer, or aluminum gallium oxide layer is used.

As each of the insulating layers (the insulating layer 712, the insulating layer 722, the insulating layer 732, and the insulating layer 742) each of which functions as a gate insulating layer, which is in contact with the oxide semiconductor layer (the oxide semiconductor layer 713, the oxide semiconductor layer 723, the oxide semiconductor layer 733, or the oxide semiconductor layer 743), an insulating layer containing oxygen is preferably used, and more preferably, the insulating layer containing oxygen includes a region (also referred to as an oxygen excessive region) where the proportion of oxygen is higher than that in the stoichiometric composition.

When the insulating layer which functions as a gate insulating layer includes an oxygen excess region, oxygen can be prevented from transferring from the oxide semiconductor layer to the insulating layer which functions as a gate insulating layer. In addition, oxygen can be supplied from the insulating layer which functions as a gate insulating layer to the oxide semiconductor layer. Thus, the oxide semiconductor layer which is in contact with the insulating layer and functions as a gate insulating layer can contain a sufficient amount of oxygen.

Each of the insulating layers (the insulating layer 712, the insulating layer 722, the insulating layer 732, and the insulating layer 742) which functions as a gate insulating layer is preferably formed by a method with which impurities such as hydrogen and water do not enter the insulating layer. This is because, when impurities such as hydrogen and water are included in the insulating layer which functions as a gate insulating layer, for example, the impurities such as hydrogen and water enter each of the oxide semiconductor layers (the oxide semiconductor layer 713, the oxide semiconductor layer 723, the oxide semiconductor layer 733, and the oxide semiconductor layer 743) or oxygen in the oxide semiconductor layer is extracted by the impurities such as hydrogen and water, so that the oxide semiconductor layer might have lower resistance (have n-type conductivity) and a parasitic channel might be formed. For example, the insulating layer which functions as a gate insulating layer is preferably formed by a sputtering method, and a high-purity gas in which impurities such as hydrogen and water are removed is preferably used as a sputtering gas.

Note that treatment for supplying oxygen is preferably performed on the insulating layer which functions as a gate insulating layer. As the treatment for supplying oxygen, heat treatment under an oxygen atmosphere, oxygen doping treatment, and the like can be given. Alternatively, oxygen may be added by performing irradiation with oxygen ions accelerated by an electric field. Note that in this specification and the like, "oxygen doping treatment" means addition of oxygen to a bulk, and the term "bulk" is used in order to clarify that oxygen is added not only to a surface of a film but also to the inside of the film. In addition, "oxygen doping" includes "oxygen plasma doping" in which oxygen which is made to be plasma is added to a bulk.

Treatment for supplying oxygen such as oxygen doping treatment is performed on the insulating layer which functions as a gate insulating layer, whereby a region where the proportion of oxygen is higher than that in the stoichiometric composition is formed in the insulating layer which functions as a gate insulating layer. Providing such a region allows oxygen to be supplied to the oxide semiconductor layer, and accordingly, oxygen deficiency in the oxide semiconductor layer or the interface between the oxide semiconductor layer and the insulating layer which functions as a gate insulating layer can be reduced.

For example, in the case where an aluminum gallium oxide layer is used as the insulating layer which function as a gate insulating layer, treatment for supplying oxygen such as oxygen doping treatment is performed, whereby the composition of aluminum gallium oxide can be $Ga_xAl_{2-x}O_{3+\alpha}$ ($0<x\leq 2$, $0<\alpha<1$).

Alternatively, an oxygen gas or a mixed gas containing an inert gas (e.g., nitrogen or a rare gas such as argon) and oxygen is introduced when the insulating layer which function as a gate insulating layer is formed by a sputtering method, whereby an oxygen excessive region may be formed in the insulating layer which function as a gate insulating layer. Note that after the film formation by a sputtering method, heat treatment may be performed.

The oxide semiconductor layers (the oxide semiconductor layer 713, the oxide semiconductor layer 723, the oxide semiconductor layer 733, and the oxide semiconductor layer 743) each function as a channel formation layer of the respective transistors. As an oxide semiconductor that can be used for the oxide semiconductor layer, the following metal oxides can be given: a four-component metal oxide (e.g., an In—Sn—Ga—Zn—O-based metal oxide), three-component metal oxides (e.g., an In—Ga—Zn—O-based metal oxide, an In—Sn—Zn—O-based metal oxide, an In—Al—Zn—O-based metal oxide, a Sn—Ga—Zn—O-based metal oxide, an Al—Ga—Zn—O-based metal oxide, a Sn—Al—Zn—O-based metal oxide, and a Hf—In—Zn—O-based metal oxide), and two-component metal oxides (e.g., an In—Zn—O-based metal oxide, a Sn—Zn—O-based metal oxide, an Al—Zn—O-based metal oxide, a Zn—Mg—O-based metal oxide, a Sn—Mg—O-based metal oxide, an In—Mg—O-based metal oxide, an In—Ga—O-based metal oxide, and an In—Sn—O-based metal oxide). As other examples of the oxide semiconductor, an In—O-based metal oxide, a Sn—O-based metal oxide, or a Zn—O-based metal oxide can be used. As another example of the oxide semiconductor, an oxide semiconductor in which the metal oxide that can be used as the oxide semiconductor contains $SiO_2$ can be used.

A material represented by $InMO_3(ZnO)_m$ ($m>0$) can be used as the oxide semiconductor. Here, M represents one or more metal elements selected from Ga, Al, Mn, and Co. For example, Ga, Ga and Al, Ga and Mn, Ga and Co, and the like can be given as M.

The conductive layers (the conductive layers 715 and 716, the conductive layers 725 and 726, the conductive layers 735 and 736, and the conductive layers 745 and 746) each function as a source or a drain of the respective transistors. For example, as each of the conductive layers, a layer of a metal material such as aluminum, chromium, copper, tantalum, titanium, molybdenum, or tungsten, or an alloy material which contains any of the metal materials as its main component is used.

For example, as each of the conductive layers each of which functions as a source or a drain of the respective transistor, a metal material layer of aluminum or copper and a high-melting-point metal layer of titanium, molybdenum, tungsten, or the like are stacked. Alternatively, a metal material layer of aluminum or copper is provided between a plurality of high-melting-point metal layers. Further, heat resistance of the respective transistors can be improved when an aluminum layer to which an element for preventing generation of hillocks and whiskers (e.g., silicon, neodymium, or scandium) is added is used as the conductive layer.

As the material of the conductive layer, indium oxide ($In_2O_3$), tin oxide ($SnO_2$), zinc oxide (ZnO), an alloy of indium oxide and tin oxide ($In_2O_3$—$SnO_2$, abbreviated to ITO), an alloy of indium oxide and zinc oxide ($In_2O_3$—ZnO), or such a metal oxide material containing silicon oxide is used.

The insulating layer 727 functions as a layer for protecting a channel formation layer of the transistor (also referred to as a channel protective layer).

For example, as each of the oxide insulating layer 717 and the oxide insulating layer 737, an oxide insulating layer such as a silicon oxide layer is used.

For example, as each of the protective insulating layer 719, the protective insulating layer 729, and the protective insulating layer 739, an inorganic insulating layer such as a silicon nitride layer, an aluminum nitride layer, silicon nitride oxide layer, or an aluminum nitride oxide layer is used.

Figure 12A:
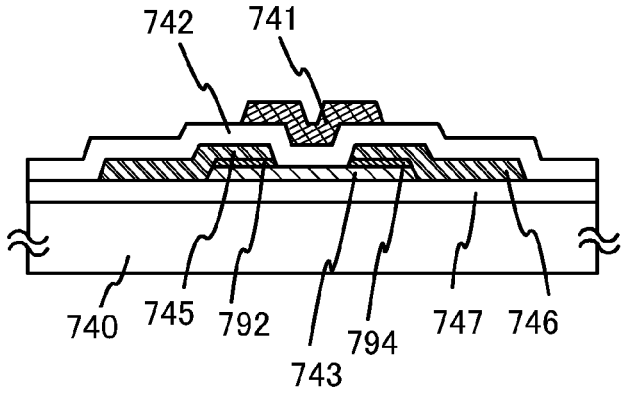
FIGS. 12A and 12B are cross-sectional views illustrating Embodiment 3.

An oxide conductive layer which functions as a source region and a drain region may be provided as a buffer layer between the oxide semiconductor layer 743 and the conductive layer 745 and between the oxide semiconductor layer 743 and the conductive layer 746. FIG. 12A illustrates a transistor in which an oxide conductive layer is provided for the transistor in FIG. 11D.

In the transistor of FIG. 12A, an oxide conductive layer 792 and an oxide conductive layer 794 each of which functions as a source region or a drain region are formed between an oxide semiconductor layer 743, and a conductive layer 745 and a conductive layer 746 each of which functions as a source or a drain. The transistor in FIG. 12B is an example in which the shapes of the oxide conductive layer 792 and the oxide conductive layer 794 differ depending on a manufacturing process.

In the transistor of FIG. 12A, an oxide semiconductor film and an oxide conductive film are stacked and processed in the same photolithography step into the oxide semiconductor layer 743 and an oxide conductive film each of which has an island shape. After the conductive layer 745 and the conductive layer 746 each of which functions as a source or a drain are formed over the oxide semiconductor layer 743 and the oxide conductive film, the island-shaped oxide conductive film is etched using the conductive layer 745 and the conductive layer 746 as masks, whereby the oxide conductive layer 792 and the oxide conductive layer 794 each of which functions as a source region or a drain region are formed.

Figure 12B:
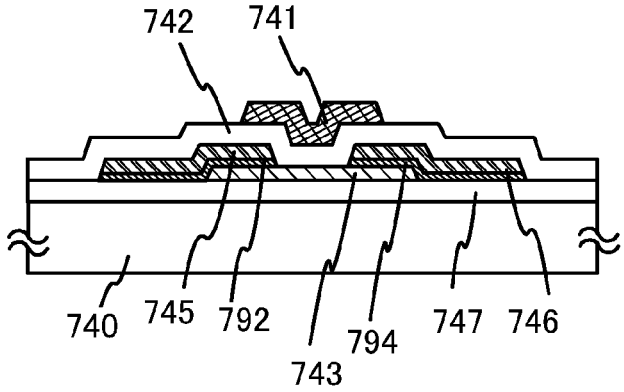

In the transistor of FIG. 12B, an oxide conductive film is formed over an oxide semiconductor layer 743, a metal conductive film is formed thereover, and the oxide conductive film and the metal conductive film are processed in the same photolithography step into an oxide conductive layer 792 and an oxide conductive layer 794 each of which functions as a source region or a drain region and a conductive layer 745 and a conductive layer 746 each of which functions as a source or a drain.

Note that when etching is performed to process the shape of the oxide conductive layer, etching conditions (such as the kind of the etchant, the concentration, and the etching time) are adjusted as appropriate so that the oxide semiconductor layer is not etched off too much.

As the formation method of the oxide conductive layer 792 and the oxide conductive layer 794, a sputtering method, a vacuum evaporation method (e.g., an electron beam evaporation method), an arc discharge ion plating method, or a spray method is used. As a material of the oxide conductive layers, zinc oxide, zinc aluminum oxide, zinc aluminum oxynitride, zinc gallium oxide, indium tin oxide containing silicon oxide (ITSO), or the like can be used. In addition, the above materials may contain silicon oxide.

When the oxide conductive layers are each provided as a source region or a drain region between the oxide semiconductor layer 743 and the conductive layer 745 or the conductive layer 746 which functions as a source or a drain, lower resistance of the source region and the drain region can be achieved and thus the transistor can operate at high speed.

With the structure of the oxide semiconductor layer 743, the oxide conductive layer (the oxide conductive layer 792 or the oxide conductive layer 794) which functions as a drain region, and the conductive layer (the conductive layer 745 or the conductive layer 746) which function as a drain, withstand voltage of the transistor can be increased.

This embodiment can be implemented in appropriate combination with the structures described in the other embodiments.

[Embodiment 4]

Figure 13A:
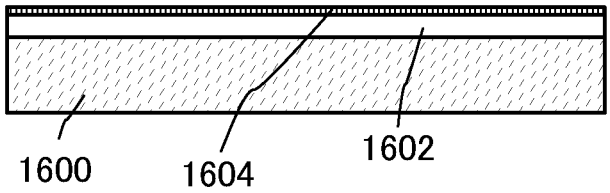
FIGS. 13A to 13C are cross-sectional views illustrating Embodiment 4.
Figure 13B:
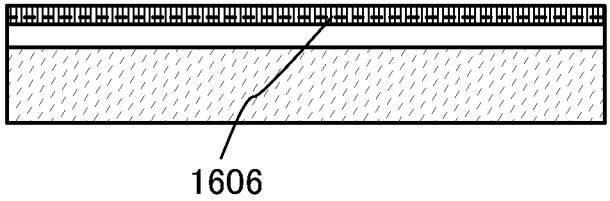

In this embodiment, an example of an oxide semiconductor layer which can be used as the semiconductor layer of the transistor in the pixel of the liquid crystal display panel 150 will be described with reference to FIGS. 13A to 13C.

The oxide semiconductor layer of this embodiment has a stacked-layer structure in which a second crystalline oxide semiconductor layer having a larger thickness than that of a first crystalline oxide semiconductor layer is formed over the first crystalline oxide semiconductor layer.

An insulating layer 1602 is formed over an insulating layer 1600. In this embodiment, as the insulating layer 1602, an oxide insulating layer having a thickness of larger than or equal to 50 nm and smaller than or equal to 600 nm is formed by a PCVD method or a sputtering method. For example, one layer selected from a silicon oxide film, a gallium oxide film, an aluminum oxide film, a silicon oxynitride film, an aluminum oxynitride film, and a silicon nitride oxide film or a stacked layer thereof can be used.

Next, a first oxide semiconductor film having a thickness of larger than or equal to 1 nm and smaller than or equal to 10 nm is formed over the insulating layer 1602. The first oxide semiconductor film is formed by a sputtering method, and a substrate temperature at the formation by a sputtering method is set to higher than or equal to 200° C. and lower than or equal to 400° C.

In this embodiment, the first oxide semiconductor film is formed to a thickness of 5 nm under an oxygen atmosphere, an argon atmosphere, or a mixed atmosphere of argon and oxygen under conditions that a target for an oxide semiconductor (a target for an In—Ga—Zn—O-based oxide semiconductor containing $In_2O_3$, $Ga_2O_3$, and ZnO at 1:1:2 [molar ratio]) is used, the distance between a substrate and the target is 160 mm, the substrate temperature is 250° C., the pressure is 0.4 Pa, and the direct current (DC) power source is 0.5 kW.

Then, first heat treatment is performed with a chamber where the substrate is placed is set under an atmosphere of nitrogen or dry air. The first heat treatment is performed at a temperature of higher than or equal to 400° C. and lower than or equal to 750° C. Through the first heat treatment, a first crystalline oxide semiconductor layer 1604 is formed (see FIG. 13A).

Although it depends on the temperature of the first heat treatment, crystallization occurs from a film surface by the first heat treatment, crystal growth proceeds from the film surface toward the inside thereof, and a c-axis-aligned crystal can be obtained. By the first heat treatment, a large amount of zinc and oxide is concentrated at the film surface, and one or a plurality of graphene-type two-dimensional crystals including zinc and oxygen, the upper flat surface each of which is hexagonal, is formed on an outermost surface. The growth of these crystals in the thickness direction of the first oxide semiconductor film proceeds and the crystals overlap with each other and stacked. In the case where the temperature of the first heat treatment is increased, the crystal growth proceeds from the surface to the inside thereof and further the inside to the bottom.

By the first heat treatment, oxygen in the insulating layer 1602 which is an oxide insulating layer is diffused into an interface between the first crystalline oxide semiconductor layer 1604 and the insulating layer 1602 or the vicinity thereof (±5 nm from the interface), whereby the oxygen deficiency in the first crystalline oxide semiconductor layer 1604 is reduced. Thus, the amount of the oxygen of the insulating layer 1602 which is used as a base insulating layer (a bulk thereof) or the amount of the oxygen at the interface between the first crystalline oxide semiconductor layer 1604 and the insulating layer 1602 is preferably greater than the stoichiometric proportion.

Next, a second oxide semiconductor film having a thickness larger than 10 nm is formed over the first crystalline oxide semiconductor layer 1604. The second oxide semiconductor film is formed by a sputtering method, and a substrate temperature at the formation is set to higher than or equal to 200° C. and lower than or equal to 400° C. When the substrate temperature at the film formation is set to higher than or equal to 200° C. and lower than or equal to 400° C., an oxide semiconductor layer which is to be formed in contact with a surface of the first crystalline oxide semiconductor layer 1604 can be ordered as a result of alignment of precursors on the oxide semiconductor layer.

In this embodiment, the second oxide semiconductor film is formed to a thickness of 25 nm under an oxygen atmosphere, an argon atmosphere, or a mixed atmosphere of argon and oxygen under conditions that a target for an oxide semiconductor (a target for an In—Ga—Zn—O-based oxide semiconductor containing $In_2O_3$, $Ga_2O_3$, and ZnO at 1:1:2 [molar ratio]) is used, the distance between the substrate and the target is 170 mm, the substrate temperature is 400° C., the pressure is 0.4 Pa, and the direct current (DC) power source is 0.5 kW.

Then, second heat treatment is performed with a chamber where the substrate is placed is set under an atmosphere of nitrogen or dry air. The second heat treatment is performed at a temperature of higher than or equal to 400° C. and lower than or equal to 750° C. Through the second heat treatment, a second crystalline oxide semiconductor layer 1606 is formed (see FIG. 13B). When the second heat treatment is performed under a nitrogen atmosphere, an oxygen atmosphere, or a mixed atmosphere of nitrogen and oxygen, high density and a reduction in the number of defects are achieved in the second crystalline oxide semiconductor layer. By the second heat treatment, the second crystalline oxide semiconductor layer 1606 is formed in the thickness direction of the second oxide semiconductor film, in which crystal growth proceeds from the bottom to the inside, using the first crystalline oxide semiconductor layer 1604 as a nucleus.

Further, it is preferable to successively perform the step of forming the insulating layer 1602 to the step of performing the second heat treatment without exposure to the air. Through the step of forming the insulating layer 1602 to the step of performing second heat treatment, the atmosphere is preferably controlled to be an atmosphere which hardly contains hydrogen and moisture (e.g., an inert atmosphere, a reduced-pressure atmosphere, or a dry-air atmosphere); for example, a dry-nitrogen atmosphere is employed in which, as for the moisture, a dew point is lower than or equal to −40° C., preferably lower than or equal to −50° C.

Figure 13C:
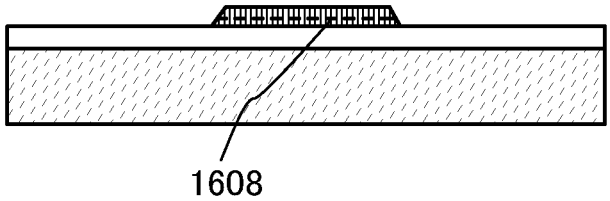

Next, a stacked layer of the first crystalline oxide semiconductor layer 1604 and the second crystalline oxide semiconductor layer 1606 is processed into an oxide semiconductor layer 1608 formed from an island-shaped oxide semiconductor layer (see FIG. 13C). In FIG. 13C, an interface between the first crystalline oxide semiconductor layer 1604 and the second crystalline oxide semiconductor layer 1606 is illustrated by a dotted line. Although the oxide semiconductors are stacked in the above description, there is no clear interface therebetween and the dotted line is illustrated just for simple understanding.

The stacked layer of the oxide semiconductor layers can be processed by etching after a mask having a desired shape is formed over the stacked layer of the oxide semiconductor layers. The mask can be formed by a method such as photolithography. Alternatively, the mask may be formed by a method such as an ink jet method.

For the etching of the stacked layer of the oxide semiconductor layers, either wet etching or dry etching may be employed. It is needless to say that both of them may be employed in combination.

One of the characteristics of the above manufacturing method is that the obtained first crystalline oxide semiconductor layer and the second crystalline oxide semiconductor layer are c-axis aligned. The first crystalline oxide semiconductor layer and the second crystalline oxide semiconductor layer comprise an oxide including a crystal with c-axis alignment (also referred to as C-Axis Aligned Crystal (CAAC)), which has neither a single crystal structure nor an amorphous structure. Note that there are crystal grain boundaries in parts of the first crystalline oxide semiconductor layer and the second crystalline oxide semiconductor layer.

Note that the first crystalline oxide semiconductor layer and the second crystalline oxide semiconductor layer are formed using an oxide material at least including Zn, and the following materials can be given: four-component metal oxides such as an In—Al—Ga—Zn—O-based material, and an In—Sn—Ga—Zn—O-based material; three-component metal oxides such as an In—Ga—Zn—O-based material, an In—Al—Zn—O-based material, an In—Sn—Zn—O-based material, an In—B—Zn—O-based material, a Sn—Ga—Zn—O-based material, an Al—Ga—Zn—O-based material, a Sn—Al—Zn—O-based material, and a Hf—In—Zn—O-based material; two-component metal oxides such as an In—Zn—O-based material, a Sn—Zn—O-based material, an Al—Zn—O-based material, and a Zn—Mg—O-based material; a Zn—O-based material; and the like. Further, an In—Si—Ga—Zn—O-based material, an In—Ga—B—Zn—O-based material, and an In—B—Zn—O-based material can be given. In addition, the above materials may contain $SiO_2$. Here, for example, an In—Ga—Zn—O-based material means an oxide film containing indium (In), gallium (Ga), and zinc (Zn), and there is no particular limitation on the composition ratio. Further, the In—Ga—Zn—O-based material may contain an element other than In, Ga, and Zn.

The oxide semiconductor layer is not limited to the two-layer structure in which the second crystalline oxide semiconductor layer over the first crystalline oxide semiconductor layer, and a stacked-layer structure of three or more layers may be employed in which, after the second crystalline oxide semiconductor layer is formed, film formation treatment and heat treatment for forming a third crystalline oxide semiconductor layer are repeated.

The oxide semiconductor layer 1608 which is formed from the stacked layer of the oxide semiconductor layers formed by the manufacturing method described above can be used as appropriate for the transistor (e.g., the transistors described in Embodiment 2 and Embodiment 3) which can be applied to the semiconductor device disclosed in this specification.

Further, in the transistor of FIG. 11D of Embodiment 3, in which a stacked layer of the first crystalline oxide semiconductor layer and the second crystalline oxide semiconductor layer is used as the oxide semiconductor layer of this embodiment, an electric field is not applied from one surface of the oxide semiconductor layer to the other surface thereof. Note that in the transistor, current does not flow in the thickness direction of the oxide semiconductor layer (a direction in which a current flows from one surface to the other surface, specifically, an up and down direction in FIG. 11D). In the transistor, a current mainly flows through an interface between the stacked layer of the oxide semiconductor layers; therefore, deterioration of transistor characteristics are suppressed or reduced even when the transistor is irradiated with light and a BT stress is applied to the transistor.

When the stacked layer of the first crystalline oxide semiconductor layer and the second crystalline oxide semiconductor layer, which is likes the oxide semiconductor layer 1608, is used for the transistor, a highly reliable transistor with stable electric characteristics can be realized.

This embodiment can be implemented in appropriate combination with the structures described in the other embodiments.

[Embodiment 5]

A liquid crystal display device including a control circuit disclosed in this specification can be applied to a variety of electronic devices (including a game machine). Examples of electronic devices include a television set (also referred to as a television or a television receiver), a monitor of a computer or the like, a camera such as a digital camera or a digital video camera, a digital photo frame, a mobile phone handset (also referred to as a mobile phone or a mobile phone device), a portable game machine, a portable information terminal, an audio reproducing device, a large-sized game machine such as a pachinko machine, and the like. Examples of electronic devices each including the liquid crystal display device described in the above embodiment are described.

Figure 14A:
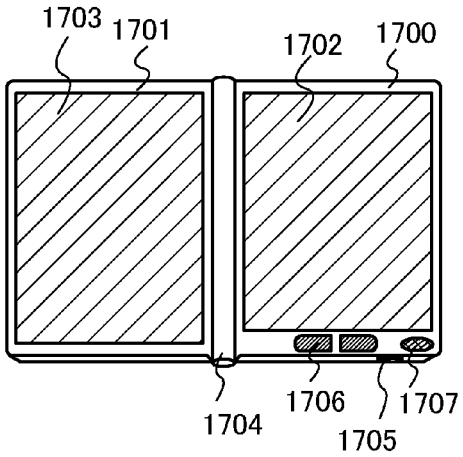
FIGS. 14A to 14D are diagrams each illustrating an electronic device of Embodiment 5.

FIG. 14A illustrates an example of an e-book reader. The e-book reader illustrated in FIG. 14A includes two housings, a housing 1700 and a housing 1701. The housing 1700 and the housing 1701 are combined with a hinge 1704 so that the e-book reader can be opened and closed. With such a structure, the e-book reader can operate like a paper book.

A display portion 1702 and a display portion 1703 are incorporated in the housing 1700 and the housing 1701, respectively. The display portion 1702 and the display portion 1703 may be configured to display one image or different images. In the case where the display portion 1702 and the display portion 1703 display different images, the display portion on the right side (the display portion 1702 in FIG. 14A) can display text and the display portion on the left side (the display portion 1703 in FIG. 14A) can display graphics, for example.

FIG. 14A shows an example of the case where the housing 1700 is provided with an operation portion and the like. For example, the housing 1700 is provided with a power supply input terminal 1705, operation keys 1706, a speaker 1707, and the like. With the operation key 1706, pages can be turned. Note that a keyboard, a pointing device, or the like may be provided on the surface of the housing, on which the display portion is provided. Further, an external connection terminal (an earphone terminal, a USB terminal, a terminal that can be connected to various cables such as a USB cable, or the like), a recording medium insert portion, or the like may be provided on the back surface or the side surface of the housing. Furthermore, the e-book reader illustrated in FIG. 14A may serve as an electronic dictionary.

Figure 14B:
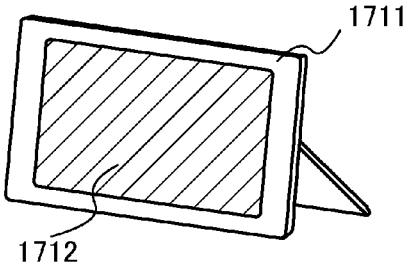

FIG. 14B shows an example of a digital photo frame using a liquid crystal display device including a control circuit disclosed in this specification. For example, in the digital photo frame illustrated in FIG. 14B, a display portion 1712 is incorporated in a housing 1711. The display portion 1712 can display various images. For example, the display portion 1712 can display data of an image taken with a digital camera or the like and thus function as a normal photo frame.

Note that the digital photo frame illustrated in FIG. 14B is provided with an operation portion, an external connection terminal (a USB terminal, a terminal that can be connected to various cables such as a USB cable, or the like), a recording medium insertion portion, and the like. Although these components may be provided on the surface on which the display portion is provided, it is preferable to provide them on the side surface or the back surface for the design of the digital photo frame. For example, a memory storing data of an image taken by a digital camera is inserted into the recording medium insertion portion of the digital photo frame, whereby the image data can be transferred and then displayed on the display portion 1712.

Figure 14C:
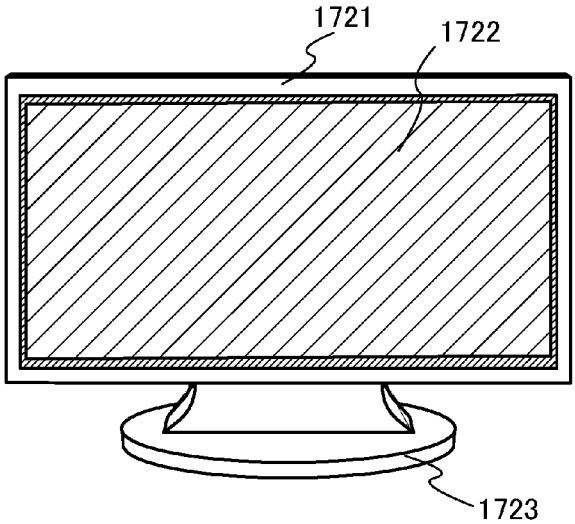

FIG. 14C shows an example of a television set using a liquid crystal display device including a control circuit. In the television set illustrated in FIG. 14C, a display portion 1722 is incorporated in a housing 1721. The display portion 1722 can display an image. Further, the housing 1721 is supported by a stand 1723 here. The liquid crystal display device including a control circuit described in any of the above embodiments can be used in the display portion 1722.

The television set illustrated in FIG. 14C can operate with an operation switch of the housing 1721 or a separate remote control device. Channels and volume can be controlled with an operation key of the remote controller so that an image displayed on the display portion 1722 can be controlled. Further, the remote controller may be provided with a display portion for displaying data output from the remote controller.

Figure 14D:
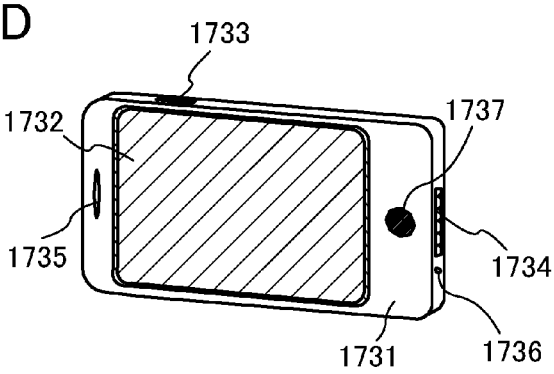

FIG. 14D shows an example of a mobile phone handset using a liquid crystal display device including a control circuit disclosed in this specification. The mobile phone handset illustrated in FIG. 14D is provided with a display portion 1732 incorporated in a housing 1731, an operation button 1733, an operation button 1737, an external connection port 1734, a speaker 1735, a microphone 1736, and the like.

The display portion 1732 of the mobile phone handset illustrated in FIG. 14D is a touch panel. When the display portion 1732 is touched with a finger or the like, contents displayed on the display portion 1732 can be controlled. Further, operations such as making calls and composing mails can be performed by touching the display portion 1732 with a finger or the like.

This embodiment can be implemented in appropriate combination with the structures described in the other embodiments.

This application is based on Japanese Patent Application serial No. 2010-181539 filed with the Japan Patent Office on Aug. 16, 2010, the entire contents of which are hereby incorporated by reference.

What is claimed is:

1. A control circuit of a liquid crystal display device comprising:

a display control circuit configured to control a liquid crystal display panel, the liquid crystal display panel configured to display a moving image in a first period and a still image in a second period; and a power supply circuit electrically connected to the display control circuit, the power supply circuit comprising an operational amplifier comprising:

a differential amplifier circuit;

a current amplifier circuit electrically connected to the differential amplifier circuit; and a source follower circuit electrically connected to the current amplifier circuit, wherein the current amplifier circuit comprises a first transistor and a second transistor, wherein the first transistor is turned on and the second transistor is turned off during the first period, wherein the first transistor is turned off and the second transistor is turned on during the second period, wherein a current supply capability of the operational amplifier is changeable depending on an amount of current flowing through the current amplifier circuit in the first period and an amount of current flowing through the current amplifier circuit in the second period, and wherein the amount of current flowing through the current amplifier circuit in the first period is different from the amount of current flowing through the current amplifier circuit in the second period.

2. The control circuit of the liquid crystal display device according to claim 1, wherein the liquid crystal display panel comprises a liquid crystal element including a pixel electrode and a counter electrode, wherein the operational amplifier is configured to control a potential of the counter electrode.

3. The control circuit of the liquid crystal display device according to claim 2 further comprising a gate driver and a source driver electrically connected to the display control circuit, wherein the gate driver and the source driver are configured to control a potential of the pixel electrode.

4. The control circuit of the liquid crystal display device according to claim 1, wherein the display control circuit comprises a memory circuit, a comparison circuit, a control signal output circuit, and a selection circuit.

5. The control circuit of the liquid crystal display device according to claim 1, wherein the liquid crystal display panel comprises a liquid crystal element and a transistor, and wherein a semiconductor film of the transistor is an oxide semiconductor.

6. An electronic device provided with the liquid crystal display device according to claim 1.

7. A control circuit of a liquid crystal display device comprising:

a display control circuit configured to control a liquid crystal display panel, the liquid crystal display panel configured to display a moving image in a first period and a still image in a second period; and a power supply circuit electrically connected to the display control circuit, the power supply circuit comprising an operational amplifier comprising:

a differential amplifier circuit;

a current amplifier circuit electrically connected to the differential amplifier circuit, the current amplifier circuit comprising:

a first current source circuit; and a second current source circuit; and a source follower circuit electrically connected to the current amplifier circuit, wherein the current amplifier circuit comprises a first transistor and a second transistor, wherein the first transistor is turned on and the second transistor is turned off during the first period, wherein the first transistor is turned off and the second transistor is turned on during the second period, wherein a current supply capability of the operational amplifier is changeable depending on an amount of current flowing through the first current source circuit in the first period and an amount of current flowing through the second current source circuit in the second period, and wherein the amount of current flowing through the first current source circuit in the first period is different from the amount of current flowing through the second current source circuit in the second period.

8. The control circuit of the liquid crystal display device according to claim 7, further comprising a control circuit electrically connected to the first current source circuit and the second current source circuit, wherein the control circuit is configured to operate the first current source circuit in the first period and the second current source circuit in the second period.

9. The control circuit of the liquid crystal display device according to claim 7, wherein the liquid crystal display panel comprises a liquid crystal element including a pixel electrode and a counter electrode, wherein the operational amplifier is configured to control a potential of the counter electrode.

10. The control circuit of the liquid crystal display device according to claim 9 further comprising a gate driver and a source driver electrically connected to the display control circuit, wherein the gate driver and the source driver are configured to control a potential of the pixel electrode.

11. The control circuit of the liquid crystal display device according to claim 7, wherein the display control circuit comprises a memory circuit, a comparison circuit, a control signal output circuit, and a selection circuit.

12. The control circuit of the liquid crystal display device according to claim 7, wherein the liquid crystal display panel comprises a liquid crystal element and a transistor, and wherein a semiconductor film of the transistor is an oxide semiconductor.

13. An electronic device provided with the liquid crystal display device according to claim 7.

14. A control circuit of a liquid crystal display device comprising:

a display control circuit configured to control a liquid crystal display panel, the liquid crystal display panel configured to display a moving image in a first period and a still image in a second period; and a power supply circuit electrically connected to the display control circuit, the power supply circuit comprising an operational amplifier comprising:

a differential amplifier circuit;
a first transistor;
a second transistor;
a third transistor;
a fourth transistor; and
a fifth transistor, wherein a gate of the first transistor is electrically connected to an output terminal of the differential amplifier circuit, wherein one of a source and a drain of the first transistor is directly connected to a high power supply voltage side terminal, wherein the other of the source and the drain of the first transistor is electrically connected to one of a source and a drain of the second transistor and one of a source and a drain of the third transistor, wherein the other of the source and the drain of the first transistor is directly connected to a gate of the fourth transistor, wherein the other of the source and the drain of the second transistor and the other of the source and the drain of the third transistor are directly connected to a low power supply voltage side terminal, wherein one of a source and a drain of the fourth transistor is directly connected to the high power supply voltage side terminal, wherein the other of the source and the drain of the fourth transistor is directly connected to one of a source and a drain of the fifth transistor, wherein the other of the source and the drain of the fifth transistor is directly connected to the low power supply voltage side terminal, wherein a current supply capability of the operational amplifier is changeable depending on an amount of current flowing through the second transistor in the first period and an amount of current flowing through the third transistor in the second period, and wherein the amount of current flowing through the second transistor in the first period is different from the amount of current flowing through the third transistor in the second period.

15. The control circuit of the liquid crystal display device according to claim 14, further comprising a control circuit electrically connected to a gate of the second transistor and a gate of the third transistor.

16. The control circuit of the liquid crystal display device according to claim 14, wherein the liquid crystal display panel comprises a liquid crystal element including a pixel electrode and a counter electrode, wherein the operational amplifier is configured to control a potential of the counter electrode.

17. The control circuit of the liquid crystal display device according to claim 16, further comprising a gate driver and a source driver electrically connected to the display control circuit, wherein the gate driver and the source driver are configured to control a potential of the pixel electrode.

18. The control circuit of the liquid crystal display device according to claim 14, wherein the display control circuit comprises a memory circuit, a comparison circuit, a control signal output circuit, and a selection circuit.

19. The control circuit of the liquid crystal display device according to claim 14, wherein the liquid crystal display panel comprises a liquid crystal element and a transistor, and wherein a semiconductor film of the transistor is an oxide semiconductor.

20. An electronic device provided with the liquid crystal display device according to claim 14.

21. A liquid crystal display device comprising:

a liquid crystal display panel configured to display a moving image in a first period and a still image in a second period;

a display control circuit configured to control the liquid crystal display panel; and a power supply circuit electrically connected to the display control circuit, the power supply circuit comprising an operational amplifier comprising:

a differential amplifier circuit;

a current amplifier circuit electrically connected to the differential amplifier circuit; and a source follower circuit electrically connected to the current amplifier circuit, wherein the current amplifier circuit comprises a first transistor and a second transistor, wherein the first transistor is turned on and the second transistor is turned off during the first period, wherein the first transistor is turned off and the second transistor is turned on during the second period, wherein a current supply capability of the operational amplifier is changeable depending on an amount of current flowing through the current amplifier circuit in the first period and an amount of current flowing through the current amplifier circuit in the second period, and wherein the amount of current flowing through the current amplifier circuit in the first period is different from the amount of current flowing through the current amplifier circuit in the second period.

22. The liquid crystal display device according to claim 21, wherein the liquid crystal display panel comprises a liquid crystal element including a pixel electrode and a counter electrode, wherein the operational amplifier is configured to control a potential of the counter electrode.

23. The liquid crystal display device according to claim 22 further comprising a gate driver and a source driver electrically connected to the display control circuit, wherein the gate driver and the source driver are configured to control a potential of the pixel electrode.

24. The liquid crystal display device according to claim 21, wherein the display control circuit comprises a memory circuit, a comparison circuit, a control signal output circuit, and a selection circuit.

25. The liquid crystal display device according to claim 21, wherein the liquid crystal display panel comprises a liquid crystal element and a transistor, and wherein a semiconductor film of the transistor is an oxide semiconductor.

26. An electronic device provided with the liquid crystal display device according to claim 21.

27. The control circuit of the liquid crystal display device according to claim 1, wherein a channel width of the first transistor and a channel width of the second transistor are different from each other.

28. The control circuit of the liquid crystal display device according to claim 7, wherein a channel width of the first transistor and a channel width of the second transistor are different from each other.

29. The control circuit of the liquid crystal display device according to claim 14, wherein a channel width of the second transistor and a channel width of the third transistor are different from each other.

30. The liquid crystal display device according to claim 21, wherein a channel width of the first transistor and a channel width of the second transistor are different from each other.

* * * * *